US009165500B2

(12) United States Patent
Kang et al.

(10) Patent No.: US 9,165,500 B2
(45) Date of Patent: Oct. 20, 2015

(54) PIXEL CIRCUIT, ORGANIC LIGHT EMITTING DISPLAY DEVICE, AND METHOD OF DRIVING THE PIXEL CIRCUIT

(75) Inventors: Chul-Kyu Kang, Yongin (KR); Seong-Il Park, Yongin (KR); Yong-Sung Park, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 617 days.

(21) Appl. No.: 13/416,950

(22) Filed: Mar. 9, 2012

(65) Prior Publication Data

US 2013/0141412 A1 Jun. 6, 2013

(30) Foreign Application Priority Data

Dec. 6, 2011 (KR) ..... 10-2011-0129547

(51) Int. Cl.
*G09G 3/32* (2006.01)
*G09G 5/00* (2006.01)

(52) U.S. Cl.
CPC ..... *G09G 3/3233* (2013.01); *G09G 2300/0852* (2013.01); *G09G 2300/0861* (2013.01)

(58) Field of Classification Search
None
See application file for complete search history.

(56) References Cited

U.S. PATENT DOCUMENTS

| | | | | |
|---|---|---|---|---|
| 2005/0243040 | A1* | 11/2005 | Miyazawa | 345/76 |
| 2006/0248420 | A1* | 11/2006 | Jeong | 714/727 |
| 2009/0051628 | A1* | 2/2009 | Kwon | 345/77 |
| 2009/0251392 | A1* | 10/2009 | Kim et al. | 345/76 |
| 2011/0025671 | A1 | 2/2011 | Lee | |
| 2011/0050674 | A1 | 3/2011 | Kim | |
| 2011/0141000 | A1 | 6/2011 | Han et al. | |

FOREIGN PATENT DOCUMENTS

| | | |
|---|---|---|
| KR | 10-2011-0013693 | 2/2011 |
| KR | 10-2011-0024099 | 3/2011 |
| KR | 10-2011-0065819 | 6/2011 |

* cited by examiner

*Primary Examiner* — Joseph Haley
*Assistant Examiner* — Emily Frank
(74) *Attorney, Agent, or Firm* — Robert E. Bushnell, Esq.

(57) ABSTRACT

A pixel circuit includes an OLED having a cathode coupled to a power source voltage, a first transistor having a second electrode coupled to an anode of the OLED, and a gate electrode coupled to a gate control-line, a second transistor having a second electrode coupled to a first electrode of the first transistor, a third transistor having a first electrode coupled to another power source voltage, a second electrode coupled to a first electrode of the second transistor, and a gate electrode coupled to a gate control-line, a fourth transistor having a first electrode coupled to a gate electrode of the second transistor, a second electrode coupled to the anode of the OLED, and a gate electrode coupled to a scan-line, and a capacitor coupled between the gate electrode of the second transistor and the second electrode of the third transistor.

17 Claims, 13 Drawing Sheets

600

PIXEL CIRCUIT, ORGANIC LIGHT EMITTING DISPLAY DEVICE, AND METHOD OF DRIVING THE PIXEL CIRCUIT

CLAIM OF PRIORITY

This application makes reference to, incorporates the same herein, and claims all benefits accruing under 35 U.S.C. §119 from an application earlier filed in the Korean Intellectual Property Office (KIPO) on the 6 Dec. 2011 and there duly assigned Serial No. 10-2011-0129547.

BACKGROUND OF THE INVENTION

1. Field of the Invention

Example embodiments relate generally to a pixel circuit, an organic light emitting display device, and a method of driving a pixel circuit. More particularly, embodiments of the inventive concept relate to a pixel circuit that compensates a threshold voltage distribution of a transistor using a few transistors and capacitors, an organic light emitting is display device that includes the pixel circuit, and a method of driving the pixel circuit.

2. Description of the Related Art

Recently, various flat panel display devices that reduce weight and volume (i.e., weakness of Cathode Ray Tube (CRT)) have been developed. The flat panel display devices include a liquid crystal display (LCD) device, a field emission display (FED) device, a plasma display panel (PDP), an organic light emitting display (OLED) device, etc.

The OLED device has advantages such as rapid response speed and low power consumption because the OLED device among the flat panel display devices displays an image using an organic light emitting diode that emits light based on recombination of electrons and holes.

Usually, the OLED device may be divided into a passive matrix type organic light emitting display (PMOLED) device and an active matrix type organic light emitting display (AMOLED) device according to a method of driving organic light emitting elements.

The AMOLED device has a plurality of scan-lines, a plurality of data-lines, a plurality of power source voltage lines, and a plurality of pixel circuits. The pixel circuits are arranged in a matrix form while being coupled to the lines. In addition, each of the pixel circuits usually includes an organic light emitting element, two transistors (i.e., a switching transistor for transferring a data signal and a driving transistor for driving the organic light emitting element based on the data signal), and one capacitor for maintaining the data signal.

As described above, although the AMOLED device has low power consumption, current intensity varies by deviation of the threshold voltage of the driving transistor (i.e., deviation of a difference between a gate voltage and a source voltage of the driving transistor). As a result, a variation of the current intensity results in display unevenness.

Namely, it is difficult to manufacture transistors of the AMOLED device to have the same characteristics (i.e., the deviation of the threshold voltage occurs among pixel circuits) because characteristics of the transistors included in the pixel circuits are changed according to manufacturing process variations.

Thus, recently, a compensation circuit including transistors and capacitors is suggested to overcome the problems. In addition, the compensation circuit is added into each of the pixel circuits. In this case, however, each pixel needs to include many transistors and capacitors therein.

In detail, as a compensation circuit is added into each of the pixel circuits, transistors, capacitors, and signal-lines controlling the transistors are added. Thus, in case of AMOLED device employing a bottom emission technique, the aperture ratio decreases and the probability of defects increases because the circuit has more components and a structure of the circuit is more complicated.

Further, recently, more than 120 Hz high-speed scan driving is required to remove motion blur phenomenon. In this case, however, recharge time decreases drastically for each of scan-lines. Namely, a capacitive load increases when each of the pixel circuits has the compensation circuit, and many transistors are formed in each of the pixel circuits coupled to a scan-line. As a result, it is difficult to implement the high-speed scan driving.

SUMMARY OF THE INVENTION

Some example embodiments provide a pixel circuit capable of compensating a threshold voltage distribution of a transistor using a few transistors and capacitors.

Some example embodiments provide an organic light emitting display device including a pixel circuit capable of compensating a threshold voltage distribution of a transistor using a few transistors and capacitors.

Some example embodiments provide a method of driving the pixel circuit.

According to some example embodiments, a pixel circuit may include an organic light emitting diode, a cathode electrode of the organic light emitting diode being coupled is to a second power source voltage, a first p-channel metal oxide semiconductor (PMOS) transistor having a first electrode, a second electrode coupled to an anode electrode of the organic light emitting diode, and a gate electrode coupled to a gate control-line, a second PMOS transistor having a first electrode and a second electrode coupled to the first electrode of the first PMOS transistor, a third PMOS transistor having a first electrode coupled to a first power source voltage, a second electrode coupled to the first electrode of the second PMOS transistor, and a gate electrode coupled to the gate control-line, a fourth PMOS transistor having a first electrode coupled to the gate electrode of the second PMOS transistor, a second electrode coupled to the anode electrode of the organic light emitting diode, and a gate electrode coupled to a scan-line, and a storage capacitor having a first electrode coupled to the first electrode of the second PMOS transistor and a data-line, and a second electrode coupled to the gate electrode of the second PMOS transistor.

In example embodiments, during an initialization period, the first power source voltage may be set as a first voltage lower than the second power source voltage, the gate electrode of the first PMOS transistor and the gate electrode of the third PMOS transistor may receive a gate control signal having a logic low level through the gate control-line, and the gate electrode of the fourth PMOS transistor may receive a scan signal having a logic high level through the scan-line.

In example embodiments, the anode electrode of the organic light emitting diode may be initialized as the first voltage as the first PMOS transistor, the second PMOS transistor, and the third PMOS transistor turn-on, and the fourth PMOS transistor turns-off during the initialization period.

In example embodiments, during a threshold voltage compensation period, the first power source voltage may be set as a second voltage lower than the second power source voltage, the gate electrode of the first PMOS transistor and the gate electrode of the third PMOS transistor may receive a gate control signal having a logic low level through the gate is control-line, and the gate electrode of the fourth PMOS transistor may receive a scan signal having a logic low level through the scan-line.

In example embodiments, a threshold voltage of the second PMOS transistor may be stored in the storage capacitor, and the anode electrode of the organic light emitting diode may be set as a voltage corresponding to the second voltage minus the threshold voltage of the second PMOS transistor as the first PMOS transistor, the second PMOS transistor, the third PMOS transistor, and the fourth PMOS transistor turn-on during the threshold voltage compensation period.

In example embodiments, during a data writing period, the gate electrode of the first PMOS transistor and the gate electrode of the third PMOS transistor may receive a gate control signal having a logic high level through the gate control-line, and the gate electrode of the fourth PMOS transistor may receive a scan signal having a logic low level through the scan-line during a scan period of the data writing period and may receive a scan signal having a logic high level during rest periods except the scan period of the data writing period.

In example embodiments, the first PMOS transistor and the third PMOS transistor may turn-off during the data writing period, the fourth PMOS transistor may turn-on during the scan period, a data signal that is provided through the data-line may be applied to the first electrode of the storage capacitor, and a voltage corresponding to a component, the component being proportional to the data signal, plus the threshold voltage of the second PMOS transistor may be stored in the storage capacitor based on a coupling effect between the storage capacitor and a parasitic capacitor of the organic light emitting diode.

In example embodiments, during an emission period, the first power source voltage may be set as a third voltage higher than the second power source voltage, the gate electrode of the first PMOS transistor and the gate electrode of the third PMOS transistor may receive a gate control signal having a logic low level through the gate control-line, and the gate electrode of the fourth PMOS transistor may receive a scan signal having a logic high level through the scan-line.

In example embodiments, a current corresponding to the data signal may flow from the first power source voltage into the second power source voltage via the organic light emitting diode by the second PMOS transistor as the first PMOS transistor and the third PMOS transistor turn-on, and the fourth PMOS transistor turns-off during the emission period. Here, the current is irrelevant to the threshold voltage of the second PMOS transistor.

In example embodiments, the pixel circuit may further include a fifth PMOS transistor having a first electrode coupled to the data-line, a second electrode coupled to the first electrode of the storage capacitor, and a gate electrode coupled to the scan-line. Here, the first electrode of the storage capacitor may be coupled to the data-line through the fifth PMOS transistor.

In example embodiments, the pixel circuit may further include an auxiliary capacitor having a first electrode coupled to the anode electrode of the organic light emitting diode and a second electrode coupled to the cathode electrode of the organic light emitting diode.

According to some example embodiments, a pixel circuit may include an organic light emitting diode, an anode electrode of the organic light emitting diode being coupled to a first power source voltage, a first n-channel metal oxide semiconductor (NMOS) transistor having a first electrode, a second electrode coupled to a cathode electrode of the organic light emitting diode, and a gate electrode coupled to a gate control-line, a second NMOS transistor having a first electrode and a second electrode coupled to the first electrode of the first NMOS transistor, a third NMOS transistor having a first electrode coupled to a second power source voltage, a second electrode coupled to the first electrode of the second NMOS transistor, and a gate electrode coupled to the gate control-line, a fourth NMOS transistor having a first electrode coupled to the gate electrode of the second NMOS transistor, a second electrode coupled to the cathode electrode of the organic light emitting diode, and a gate electrode coupled to a scan-line, and a storage capacitor having a first electrode is coupled to the first electrode of the second NMOS transistor and a data-line, and a second electrode coupled to the gate electrode of the second NMOS transistor.

In example embodiments, the pixel circuit may further include a fifth NMOS transistor having a first electrode coupled to the data-line, a second electrode coupled to the first electrode of the storage capacitor, and a gate electrode coupled to the scan-line. Here, the first electrode of the storage capacitor may be coupled to the data-line through the fifth NMOS transistor.

In example embodiments, the pixel circuit may further include an auxiliary capacitor having a first electrode coupled to the anode electrode of the organic light emitting diode, and a second electrode coupled to the cathode electrode of the organic light emitting diode.

According to some example embodiments, an organic light emitting display device may include a pixel unit having a plurality of pixel circuits that are placed at crossing points of a plurality of scan-lines, a plurality of gate control-lines, and a plurality of data-lines, a scan driver that provides a scan signal to the scan-lines, a gate driver that provides a gate control signal to the gate control-lines, a data driver that provides a data signal to the data control-lines, and a voltage generation unit that provides a first power source voltage and a second power source voltage to the pixel unit. Here, each of the pixel circuits may include an organic light emitting diode, a cathode electrode of the organic light emitting diode being coupled to the second power source voltage, a first PMOS transistor having a first electrode, a second electrode coupled to an anode electrode of the organic light emitting diode, and a gate electrode coupled to the gate control-line, a second PMOS transistor having a first electrode and a second electrode coupled to the first electrode of the first PMOS transistor, a third PMOS transistor having a first electrode coupled to the first power source voltage, a second electrode coupled to the first electrode of the second PMOS transistor, and a gate electrode coupled to the gate control-line, a fourth PMOS transistor having a first electrode coupled to the gate electrode of the second PMOS transistor, a second electrode coupled to is the anode electrode of the organic light emitting diode, and a gate electrode coupled to the scan-line, and a storage capacitor having a first electrode coupled to the first electrode of the second PMOS transistor and the data-line, and a second electrode coupled to the gate electrode of the second PMOS transistor.

In example embodiments, the pixel unit may write image data in each of the pixel circuits during a data writing period of one frame period, and each of the pixel circuits simultaneously may emit light during an emission period of one frame period by the pixel unit.

In example embodiments, during the data writing period, the gate driver may simultaneously apply the gate control signal having a logic high level to each of the gate control-lines, and the scan driver may sequentially apply the scan signal having a logic low level to each of the scan-lines.

In example embodiments, during the data writing period, the first PMOS transistor and the third PMOS transistor may turn-off, and a voltage corresponding to a component, the component being proportional to data signal that is provided through the data driver, plus the threshold voltage of the second PMOS transistor may be stored in the storage capacitor based on a coupling effect of the storage capacitor and a parasitic capacitor of the organic light emitting diode. Here, the first PMOS transistor, the third PMOS transistor, the storage capacitor, and the parasitic capacitor of the organic light emitting diode may be included in each of the pixel circuits.

According to some example embodiments, a method of driving a pixel circuit, the method may include a step of initializing a first electrode of an organic light emitting diode as a first power source voltage by turning on a first transistor, a driving transistor, and a second transistor that are sequentially coupled between the first electrode of the organic light emitting diode and the first power source voltage, a step of storing a threshold voltage of the driving transistor in a storage capacitor having a first electrode coupled to a gate electrode of the driving transistor, and a second electrode coupled to a conjunction node of the driving is transistor and the second transistor, a step of applying a data signal to a second electrode of the storage capacitor as the first transistor and the second transistor turn-off, and the first electrode of the storage capacitor is coupled to the first electrode of the organic light emitting diode, and a step of controlling the organic light emitting diode to emit light as a current corresponding to the data signal passes through the organic light emitting diode via the driving transistor.

In example embodiments, the step of storing the threshold voltage of the driving transistor in the storage capacitor may include a step of turning-on the first transistor and the second transistor, and a step of coupling the first electrode of the storage capacitor to the first electrode of the organic light emitting diode.

In example embodiments, a step of applying the data signal may include a step of storing a voltage corresponding to a component, the component being proportional to the data signal, plus the threshold voltage of the driving transistor in the storage capacitor based on a coupling effect between the storage capacitor and a parasitic capacitor of the organic light emitting diode.

In example embodiments, a step of controlling the organic light emitting diode to emit light may include a step of turning-on the first transistor and the second transistor, and a step of blocking the first electrode of the storage capacitor from the first electrode of the organic light emitting diode.

Therefore, the pixel circuit may be implemented using a few transistors and capacitors because the pixel circuit operates by storing a data signal in a storage capacitor based on a coupling effect between the storage capacitor and a parasitic capacitor of an organic light emitting diode.

In addition, the organic light emitting display device may provide a uniform image, may improve a process yield ratio and an aperture ratio because the organic light emitting display device includes the pixel circuit that is implemented using a few transistors and capacitors, and may enable a high-speed scan driving because a capacitive load coupled to is a scan-line decreases.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
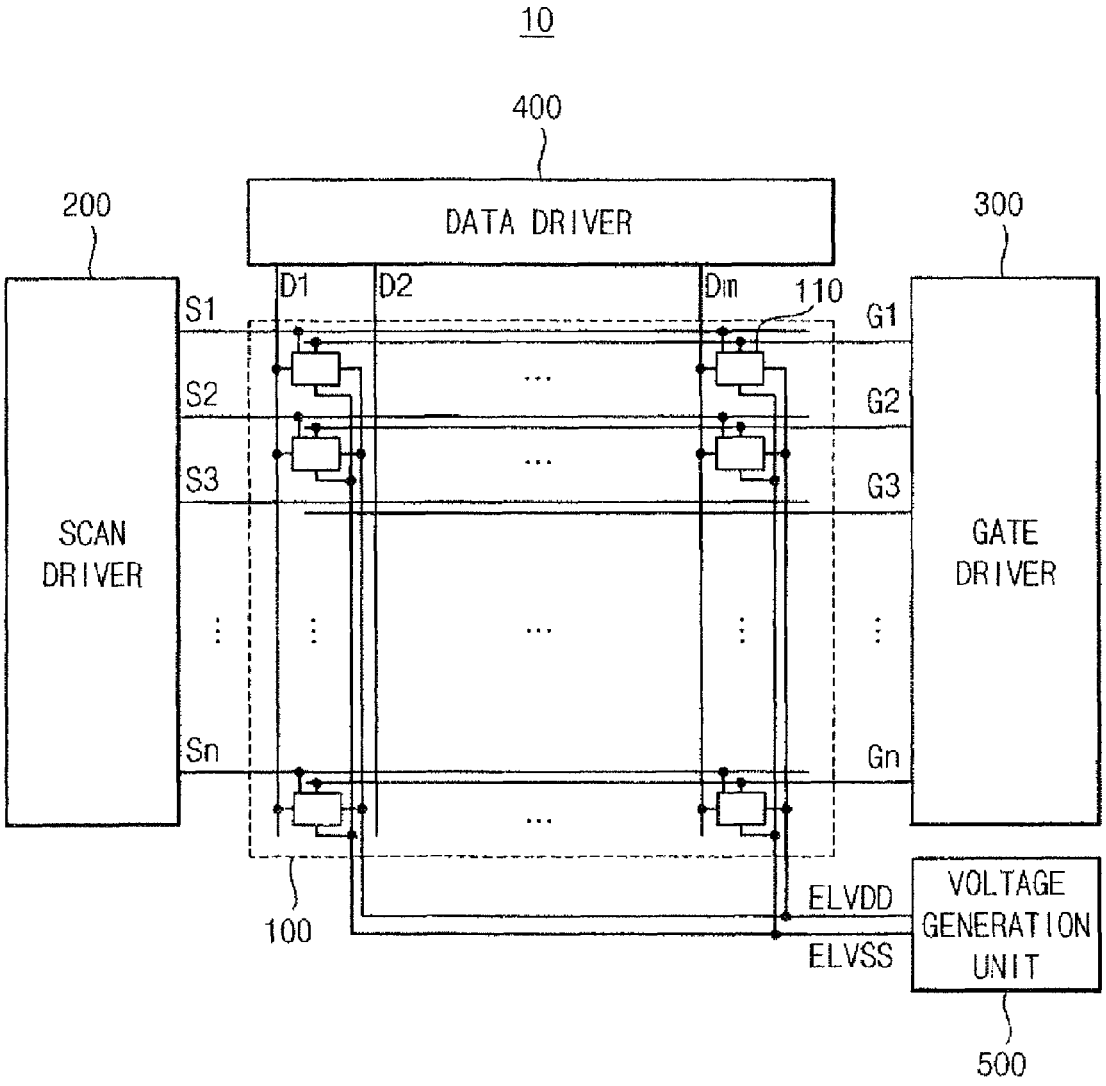
FIG. 1 is a block diagram illustrating an organic light emitting display (OLED) device according to example embodiments of the invention.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening is elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating an organic light emitting display (OLED) device according to example embodiments.

Referring to FIG. 1, the organic light emitting display (OLED) device 10 includes a pixel unit 100, a scan driver 200, a gate driver 300, a data driver 400, and a voltage generation unit 500.

The scan driver 200, the gate driver 300, the data driver 400, and the voltage generation unit 500 may be implemented by one integrated circuit chip (IC).

The pixel unit 100 is coupled to the scan driver 200 through a plurality of scan-lines S1 through Sn (here, n denotes a positive integer). The pixel unit 100 is coupled to the gate driver 300 through a plurality of gate control-lines G1 through Gn. The pixel unit 100 is coupled to the data driver 400 through a plurality of data-lines D1 through Dm (here, m denotes a positive integer). The voltage generation unit 500 may provide the pixel unit 100 with a first power source voltage ELVDD and a second power source voltage ELVSS.

The pixel unit 100 includes n×m pixel circuits 110 that are placed at crossing points of the scan-lines S1 through Sn, the gate control-lines G1 through Gn, and the data-lines D1 through Dm. As described below, each of the pixel circuits 110 includes an organic light emitting diode.

The scan driver 200 provides a scan signal to each of the pixel circuits 110 through the scan-lines S1 through Sn.

The gate driver 300 provides a gate control signal to each of the pixel circuits 110 through the gate control-lines G1 through Gn.

The data driver 400 provides a data signal to each of the pixel circuits 110 through the data-lines D1 through Dm.

The voltage generation unit 500 provides the first power source voltage ELVDD and the second power source voltage ELVSS to each of the pixel circuits 110.

Each of the pixel circuits 110 receives the scan signal, the gate control signal, the data signal, the first power source voltage ELVDD, and the second power source voltage ELVSS, and control the organic light emitting diode to emit light based on luminance corresponding to the data signal.

Figure 2:
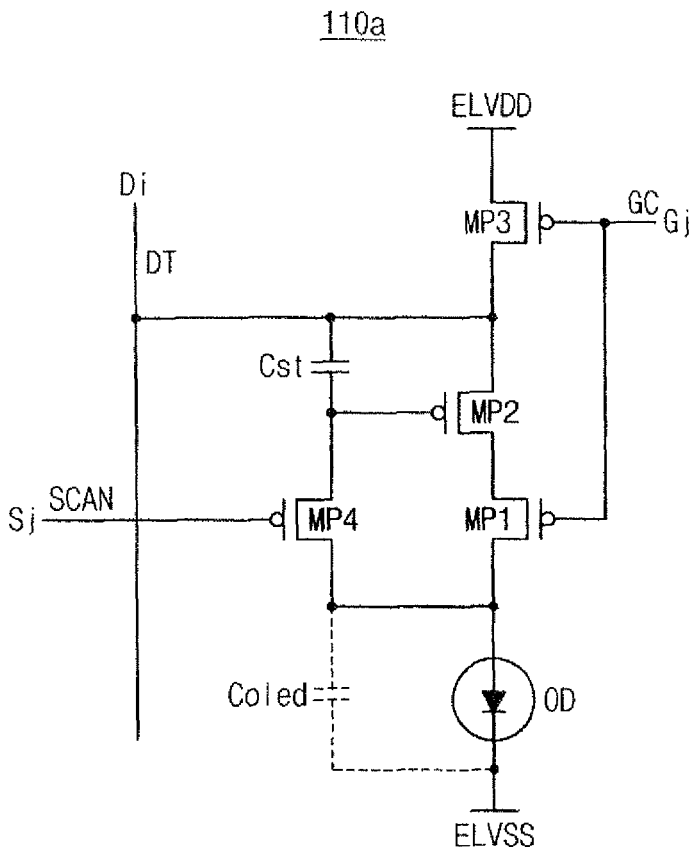
FIG. 2 is a circuit diagram illustrating a first example of a pixel circuit included in an organic light emitting display (OLED) device of FIG. 1.

FIG. 2 is a circuit diagram illustrating an example of a pixel circuit included in an organic light emitting display (OLED) device of FIG. 1.

A pixel circuit 110 in the organic light emitting display device 10 of FIG. 1 may correspond to a pixel circuit 110*a* illustrated in FIG. 2.

In an example illustrated in FIG. 2, the pixel circuit 110*a* may be implemented by p-channel metal oxide semiconductor (PMOS) transistors.

FIG. 2 shows the pixel circuit 110 that is placed at (j)th column and (i)th row (here, i and j are positive integers).

The pixel circuit 110*a* receives a scan signal SCAN through a scan-line Sj from the scan driver 200 of FIG. 1. The pixel circuit 110*a* receives a gate control signal GC through a gate control-line Gj from the gate driver 300 of FIG. 1. The pixel circuit 110*a* receives a data signal DT through a data-line Di from the data driver 400 of FIG. 1. In addition, the pixel circuit 110*a* is supplied with the first power source voltage ELVDD and the second power source voltage ELVSS from the voltage generation unit 500 of FIG. 1.

Referring to FIG. 2, the pixel circuit 110*a* includes an organic light emitting diode OD, a PMOS transistor MP1, a PMOS transistor MP2, a PMOS transistor MP3, a PMOS transistor MP4 and a storage capacitor Cst.

The organic light emitting diode OD includes a cathode electrode that is coupled to the second power source voltage ELVSS and an anode electrode that is coupled to a second electrode of the PMOS transistor MP1.

The PMOS transistor MP1 includes a first electrode that is coupled to a second electrode of the PMOS transistor MP2, the second electrode that is coupled to the anode electrode of the organic light emitting diode OD, and a gate electrode that is coupled to the gate control-line Gj.

The PMOS transistor MP2 includes a first electrode that is coupled to a second electrode of the PMOS transistor MP3, the second electrode that is coupled to the first electrode of the PMOS transistor MP1, and a gate electrode that is coupled, in common, to a first electrode of the PMOS transistor MP4 and a second electrode of a storage capacitor Cst. The PMOS transistor MP2 may operate as a driving transistor. The first electrode of the PMOS transistor MP2 may be a source electrode, and the second electrode of the PMOS transistor MP2 may be a drain electrode.

The PMOS transistor MP3 includes a first electrode that is coupled to the first power source voltage ELVDD, the second electrode that is coupled, in common, to the first electrode of the PMOS transistor MP2 and a first electrode of the storage capacitor Cst, and a gate electrode that is coupled to a gate control-line Gj.

The PMOS transistor MP4 includes the first electrode that is coupled, in common, to the gate electrode of the PMOS transistor MP2 and the second electrode of the storage capacitor Cst, the second electrode that is coupled, in common, to the second electrode of the PMOS transistor MP1 and the anode electrode of the organic light emitting diode OD, and a gate electrode that is coupled to a scan-line Sj.

The storage capacitor Cst includes the first electrode that is coupled, in common, to the first electrode of the PMOS transistor MP2 and a data-line Di, and the second electrode that is coupled, in common, to the gate electrode of the PMOS transistor MP2 and the first electrode of the PMOS transistor MP4.

In addition, the organic light emitting diode OD internally includes a parasitic capacitor Coled that is generated by the anode electrode and the cathode electrode of the organic light emitting diode OD. The parasitic capacitor Coled that internally exists in the organic light emitting diode OD is indicated by the dotted line between the anode electrode and the cathode electrode of the organic light emitting diode OD in FIG. 2

As described below, the pixel circuit 110*a* according to example embodiments uses a coupling effect between the storage capacitor Cst and the parasitic capacitor Coled that internally exists in the organic light emitting diode OD when a data signal DT provided through the data-line Di is stored in the storage capacitor Cst.

Figure 3:
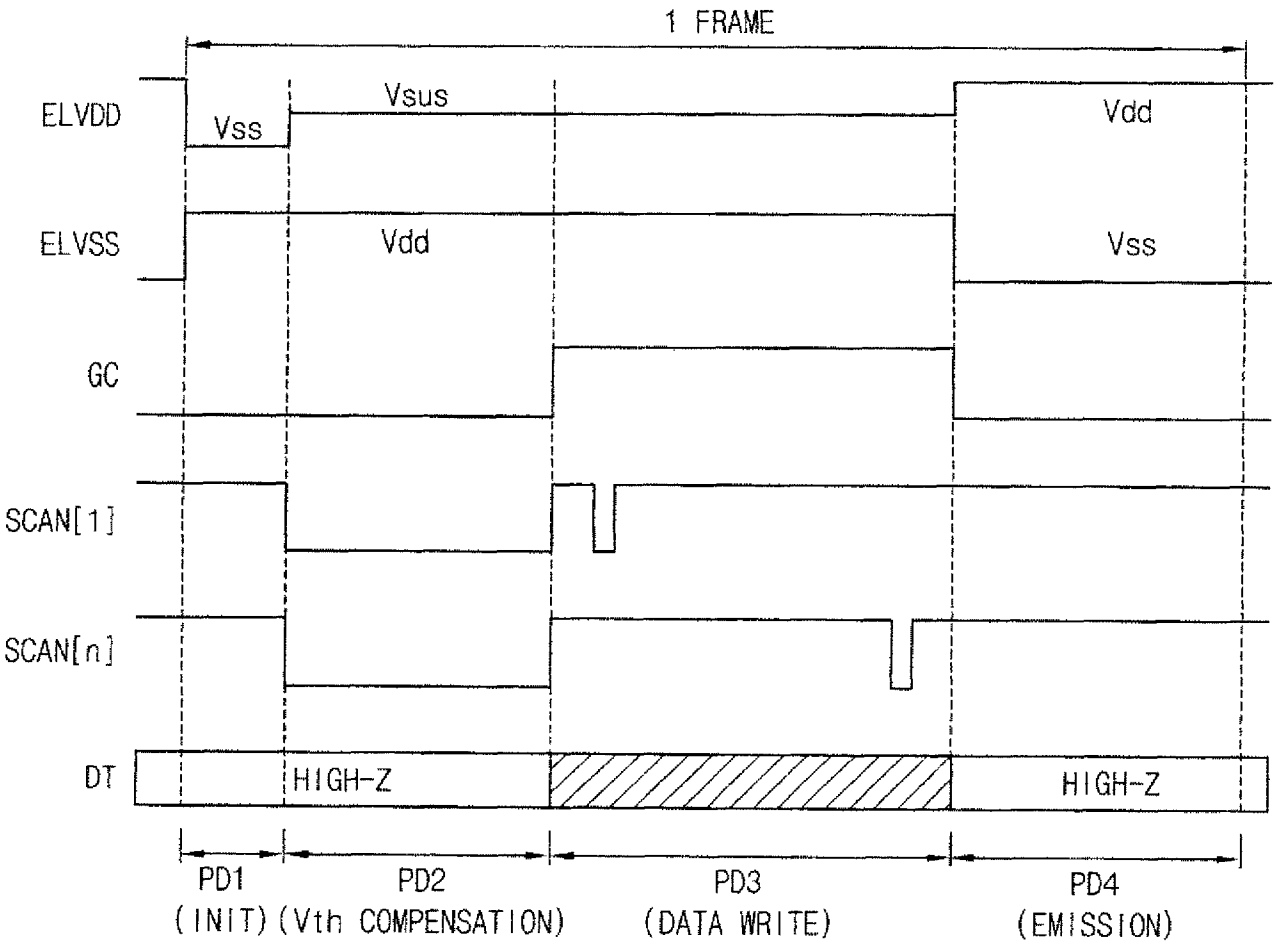
FIG. 3 is a timing diagram illustrating an operation of an organic light emitting display (OLED) device of FIG. 1.

FIG. 3 is a timing diagram illustrating an operation of an organic light emitting display (OLED) device of FIG. 1.

A pixel unit 100 in the organic light emitting display (OLED) device 10 of FIG. 1 may include the pixel circuit 110*a* of FIG. 2.

In FIG. 3, ELVDD represents a first power source voltage that is provided from voltage generation unit 500 to the pixel circuit 110*a*, and ELVSS represents a second power source voltage that is provided from voltage generation unit 500 to pixel circuit 110*a*. In addition, GC represents a gate control signal GC that is provided from gate driver 300 to pixel circuit 110*a*, and DT represents a data signal DT that is provided from data driver 400 is to pixel circuit 110*a*. SCAN[1] represents a scan signal SCAN[1] that is provided from scan driver 200 to pixel circuit 110*a* that is coupled to first scan-line S1. Thus, SCAN[n] represents a scan signal SCAN[n] that is provided from scan driver 200 to pixel circuit 110*a* that is coupled to (n)th scan-line Sn.

Referring to FIG. 3, one frame period is divided into an initialization period PD1, a threshold voltage compensation period PD2, a data writing period PD3, and an emission period PD4.

As illustrated in FIG. 3, the gate control signal GC, the first power source voltage ELVDD, and the second power source voltage ELVSS may be commonly applied to all pixel circuits 110*a* that are included in the pixel unit 100 during the initialization period PD1, the threshold voltage compensation period PD2, the data writing period PD3, and the emission period PD4. In addition, the scan signals SCAN[1] through SCAN[n] may be commonly applied to all pixel circuits 110*a* that are included in the pixel unit 100 during the initialization period PD1, the threshold voltage compensation period PD2, and the emission period PD4. However, the scan signals SCAN[1] through SCAN[n] may be sequentially applied to each of the pixel circuits 110*a* that is coupled to each of the scan-lines S1 through Sn during the data writing period PD3. Therefore, the data writing period PD3 may be sequentially performed for the pixel circuits 110*a* that are coupled to the scan-lines S1 through Sn. However, the initialization period PD1, the threshold voltage compensation period PD2, and the emission period PD4 may be simultaneously performed for the pixel circuits 110*a* that are coupled to the scan-lines S1 through Sn.

During the initialization period PD1, a voltage of an anode electrode of the organic light emitting diode OD that is included in each of the pixel circuits 110*a* is initialized. During the threshold voltage compensation period PD2, a threshold voltage of the PMOS transistor MP2 is stored between both electrodes of the storage capacitor Cst. That is, the PMOS transistor MP2 may operate as a driving transistor in each of the pixel circuits 110*a*. During the data writing period PD3, the data signal DT is sequentially stored in the storage is capacitor Cst of each of the pixel circuits 110*a*. During the emission period PD4, light emitting is simultaneously performed in all pixel circuits 110*a* that are included in the pixel unit 100. Therefore, the organic light emitting display (OLED) device 10 may be not driven by a progressive emission technique but by a simultaneous emission with active voltage (SEAV) control technique.

Hereinafter, referring to FIG. 1, FIG. 2, and FIG. 3, operations of the organic light emitting display device (OLED) 10 will be described in detail.

During the initialization period PD1, the voltage generation unit 500 may set the first power source voltage ELVDD as a first voltage Vss, and may provide the first voltage Vss to the pixel circuit 110*a*. In addition, the voltage generation unit 500 may set the second power source voltage ELVSS as a third voltage Vdd, and may provide the third voltage Vdd to the pixel circuit 110*a*. The first voltage Vss may be lower than the third voltage Vdd. For instance, the first voltage Vss may be about 0V, and the third voltage Vdd may be about 12V. The gate driver 300 may provide the gate control signal GC having a logic low level to the pixel circuit 110*a* through the gate control-line Gj. The scan driver 200 may provide the scan signal SCAN having a logic high level to the pixel circuit 110*a* through the scan-line Sj. The data driver 400 may provide the data signal DT that is in a high impedance (i.e., HIGH-Z) state to the data-line Di.

Therefore, during the initialization period PD1, PMOS transistor MP1 and PMOS transistor MP3 turn-on as the gate signal GC having a logic low level is applied to the gate electrode of PMOS transistor MP1 and the gate electrode of PMOS transistor MP3. In addition, PMOS transistor MP4 turns-off as the scan signal SCAN having a logic high level is applied to the gate electrode of PMOS transistor MP4. Further, PMOS transistor MP2 turns-on as the first power source voltage ELVDD is applied as the first voltage Vss having a logic low level, and the gate electrode of PMOS transistor MP2 has a voltage having a logic low level through storage capacitor Cst.

Namely, PMOS transistor MP1 and PMOS transistor MP3 turn on, and a current is channel is formed between the first electrode and the second electrode of PMOS transistor MP2. Thus, the anode electrode of the organic light emitting diode OD is initialized to have the first power source voltage ELVDD (i.e., the first voltage Vss).

Then, during the threshold voltage compensation period PD2, the first power source voltage ELVDD may be set as a second voltage Vsus, and may be provided to the pixel circuit 110*a* by a voltage generation unit 500. Here, the second voltage Vsus is higher than the first voltage Vss, and is lower than the third voltage Vdd. In addition, the second power source voltage ELVSS may be set as the third voltage Vdd, and may be provided to the pixel circuit 110*a* by the voltage generation unit 500. For instance, the second voltage Vsus may be about 7V. The gate driver 300 may provide the gate control signal GC having a logic low level to the pixel circuit 110*a* through a gate control-line Gj. The scan driver 200 may provide the scan signal SCAN having a logic low level to the pixel circuit 110*a* through a scan-line Sj. The data driver 400 may provide the data signal DT that is in a high impedance (i.e., HIGH-Z) state to the data-line Di.

Thus, during the threshold voltage compensation period PD2, PMOS transistor MP1 and PMOS transistor MP3 are maintained in a turn-on state because the gate signal GC having a logic low level is applied to the gate electrode of PMOS transistor MP1 and the gate electrode of PMOS transistor MP3. PMOS transistor MP2 is also maintained in a turn-on state. Meanwhile, PMOS transistor MP4 turns-on as the scan signal SCAN having a logic low level is applied to the gate electrode of PMOS transistor MP4. Thus, the second electrode of storage capacitor Cst and the gate electrode of PMOS transistor MP2 are electrically coupled to the anode electrode of organic light emitting diode OD.

Therefore, a current flows from the first power source voltage ELVDD to the anode electrode of organic light emitting diode OD until the threshold voltage of PMOS transistor MP2 is stored between both electrodes of storage capacitor Cst because a current channel is generated between the first power source voltage ELVDD and the anode electrode of organic light emitting diode OD. As a result, the threshold voltage of PMOS transistor MP2 is stored is between both electrodes of storage capacitor Cst, and a voltage of the anode electrode of organic light emitting diode OD equals a voltage corresponding to the second voltage Vss minus the threshold voltage of PMOS transistor MP2.

Then, during the data writing period PD3, the first power source voltage ELVDD may be set as the second voltage Vsus, and may be provided to pixel circuit 110*a* by voltage generation unit 500. The second power source voltage ELVSS may be set as the third voltage Vdd, and may be provided to pixel circuit 110*a* by voltage generation unit 500. The gate driver 300 may provide the gate control signal GC having a logic high level to pixel circuit 110*a* through a gate control-line Gj. The scan driver 200 may sequentially provide the scan signal SCAN having a logic low level to the scan-lines S1 through Sn. In detail, the scan driver 200 may provide the scan signal SCAN having a logic low level during the scan period in the data writing period PD3, and may provide the scan signal SCAN having a high level during the rest periods except the scan period in the data writing period PD3. The scan period may be sequentially set for the scan-lines S1 though Sn. The data driver 400 may provide the data signal DT corresponding to an image data that is displayed in pixel circuit 110*a* to the data-line Di.

Namely, during the data writing period PD3, the current that flows into the anode electrode of organic light emitting diode OD through PMOS transistor MP2 is blocked because PMOS transistor MP1 and PMOS transistor MP3 turn-off. In addition, during the threshold voltage compensation period PD2, the threshold voltage of PMOS transistor MP2 is stored in both electrodes of storage capacitor Cst, and a voltage corresponding to the second voltage Vsus minus the threshold voltage of PMOS transistor MP2 is stored in the anode electrode of the organic light emitting diode OD. Thus, as the data signal DT is applied to the first electrode of storage capacitor Cst during the scan period, a coupling effect between storage capacitor Cst and a parasitic capacitor Coled that is placed in the organic light emitting diode OD is caused, and a voltage corresponding to a component, the component being proportional to the data signal DT, plus the threshold voltage of PMOS is transistor MP2 is stored between both electrodes of storage capacitor Cst.

In detail, during the data writing period PD3, the voltage stored between both electrodes of storage capacitor Cst is expressed as Equation 1:

$$Vst=(Vsus-V\text{data})*(Coled/(Coled+Cst))+Vth \qquad \text{Equation 1}$$

(Here, Vst denotes a voltage stored between both electrodes of the storage capacitor Cst, Vdata denotes a voltage of the data signal DT, and Vth denotes the threshold voltage of PMOS transistor MP2).

Then, during the emission period PD4, the voltage generation unit 500 may set the first power source voltage ELVDD as the third voltage Vdd, and may provide the third voltage Vdd to pixel circuit 110*a*. In addition, the voltage generation unit 500 may set the second power source voltage ELVSS as the first voltage Vss, and may provide the first voltage Vss to pixel circuit 110*a*. The gate driver 300 may provide the gate control signal GC having a logic low level to pixel circuit 110*a* through the gate control-line Gj. The scan driver 200 may provide the scan signal SCAN having a high level to pixel circuit 110*a* through the scan-line Sj. The data driver 400 may provide the data signal that is in a high impedance (i.e., HIGH-Z) state to a data-line Di.

Namely, during the emission period PD4, PMOS transistor MP1 and PMOS transistor MP3 turn-on as the gate signal GC having a logic low level is applied to the gate electrode of PMOS transistor MP1 and the gate electrode of PMOS transistor MP3. In addition, PMOS transistor MP4 turns-off as the scan signal SCAN having a logic high level is applied to the gate electrode of PMOS transistor MP4.

As illustrated in FIG. 2, during the emission period PD4, a current (i.e., the current corresponds to the voltage stored in the storage capacitor Cst minus the threshold voltage of PMOS transistor MP2) flows through PMOS transistor MP2 as storage capacitor Cst is coupled between the gate electrode and the source electrode of PMOS transistor MP2.

As described above, the voltage stored between both electrodes of storage capacitor Cst during the data writing period PD3 is shown in Equation 1. Thus, the current that flows into the organic light emitting diode OD through PMOS transistor MP2 during the emission period PD4 is expressed as Equation 2:

$$\begin{aligned} Ioled &= b/2*(Vgs-Vth)^2 \qquad \text{Equation 2} \\ &= b/2*(Vst-Vth)^2 \\ &= b/2*((Vsus-Vdata)*(Coled/(Coled+Cst)))^2 \end{aligned}$$

(Here, Ioled denotes a current that flows through the organic light emitting diode OD, b denotes a constant value, and Vgs denotes a voltage between the gate electrode and the source electrode of PMOS transistor MP2).

That is, the current Ioled that flows through the organic light emitting diode OD is irrelevant to the threshold voltage of PMOS transistor MP2 that operates as the driving transistor, and is determined only by the data signal DT.

Therefore, pixel circuit 110*a* according to example embodiments may be irrelevant to the threshold voltage of PMOS transistor MP2 that operates as the driving transistor, and may emit light having a luminance determined only by the data signal DT. In addition, the organic light emitting diode display device 10 having the pixel circuit 110*a* may compensate the deviation of the threshold voltage of each driving transistor, and may provide a uniform image.

Conventionally, in order to compensate the deviation of the threshold voltage of each driving transistor, a compensation circuit having a plurality of transistors and capacitors was used for each pixel circuit. Therefore, when the compensation circuit is added to each pixel circuit, the aperture ratio decreases because transistors and capacitors included in each pixel circuit, and signal-lines for controlling the transistors are added. In addition, the probability of defects increases because components of the pixel circuit increase, and the structure of the pixel circuit is complicated. Further, it is difficult to implement a high-speed scan driving because a capacitive load that is coupled to a scan-line increases.

However, as described above, the pixel circuit 110*a* according to example embodiments may be implemented using four transistors and one storage capacitor Cst, and may store the data signal DT based on a coupling effect between storage capacitor Cst and the parasitic capacitor Coled of organic light emitting diode OD. Accordingly, the process yield ratio and the aperture ratio may be improved because each pixel circuit is implemented using a few transistors and capacitors, and the high-speed scan driving may be enabled because a capacitive load that is coupled to a scan-line decreases.

Figure 4:
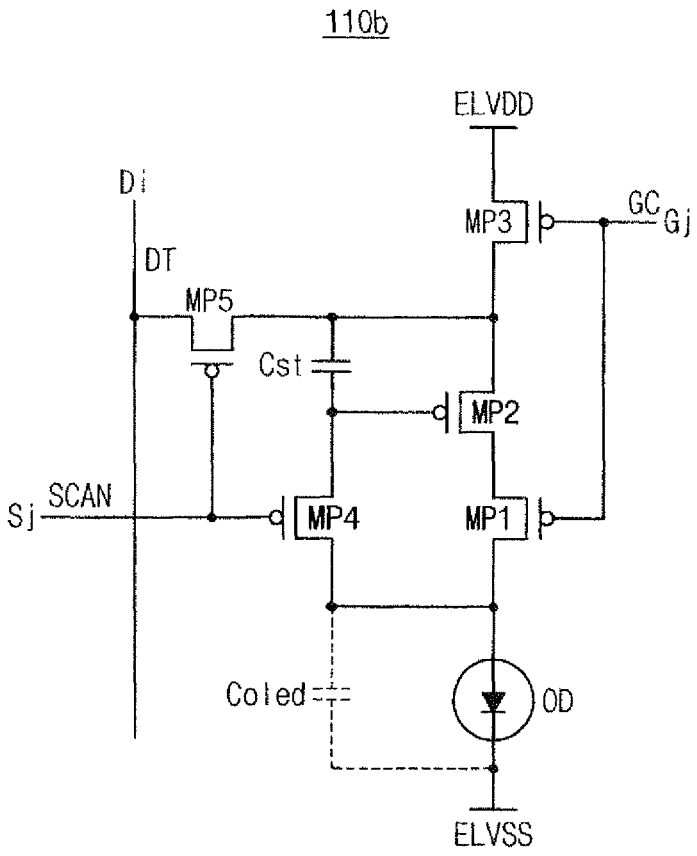
FIG. 4 is circuit diagram illustrating a first modification of the pixel circuit of FIG. 2.

FIG. 4 is a circuit diagram illustrating a first modification of the pixel circuit of FIG. 2 included in an organic light emitting display (OLED) device of FIG. 1.

A pixel circuit 110 in the organic light emitting display (OLED) device 10 of FIG. 1 may have the structure of a pixel circuit 110*b* illustrated in FIG. 4. In FIG. 4, the pixel circuit 110*b* is assumed to be placed at (j)th row and (i)th column.

Referring to FIG. 4, the pixel circuit 110*b* includes organic light emitting diode OD, PMOS transistor MP1, PMOS transistor MP2, PMOS transistor MP3, PMOS transistor MP4, storage capacitor Cst, and a PMOS transistor MP5.

Comparing the pixel circuit 110*b* of FIG. 4 with the pixel circuit 110*a* of FIG. 2, the pixel circuit 110*b* of FIG. 4 may be equal to the pixel circuit 110*a* of FIG. 2 except that the PMOS transistor MP5 is included in the pixel circuit 110*b* of FIG. 4. Therefore, only the PMOS transistor MP5 will be described because the structure and the operation of the pixel circuit 110*a* of FIG. 2 were described referring to FIG. 1, FIG. 2, and FIG. 3.

The PMOS transistor MP5 includes a first electrode, a second electrode, a gate electrode, the first electrode is coupled to data-line Di, the second electrode is coupled, in common, to the first electrode of PMOS transistor MP2 and the first electrode of the storage capacitor Cst, the gate electrode is coupled to scan-line Sj. Therefore, the first electrode of PMOS transistor MP2 and the first electrode of storage capacitor Cst are not directly coupled to the data-line Di. That is, the first electrode of PMOS transistor MP2 and the first electrode of storage capacitor Cst are coupled to the data-line Di through the PMOS is transistor MP5.

The organic light emitting display (OLED) device 10 may equally operate as a timing diagram shown in FIG. 3 even if the pixel unit 100 in the organic light emitting display (OLED) device 10 of FIG. 1 includes the pixel circuit 110*b* of FIG. 4.

As described above, scan driver 200 may provide a scan signal SCAN having a logic low level only during a scan period in the data writing periods PD3, and may provide a scan signal SCAN having a logic high level during the rest periods except the scan period in the data writing periods PD3.

Namely, a data signal DT provided through the data-line Di is applied to the first electrode of storage capacitor Cst as PMOS transistor MP5 turns-on only during the scan period in the data writing period PD3. However, a data-line Di is electrically blocked from the first electrode of storage capacitor Cst as PMOS transistor MP5 turns-off during the rest periods except the scan period in the data writing period PD3.

Therefore, while the data signal DT is written in the pixel circuits 110*b* coupled to other scan-lines, the first electrode of storage capacitor Cst and data-line Di may be electrically blocked by PMOS transistor MP5. Thus, PMOS transistor MP5 may prevent the voltage that is stored between both electrodes of storage capacitor Cst from being changed by the data signal DT that is written in other scan-lines.

Figure 5:
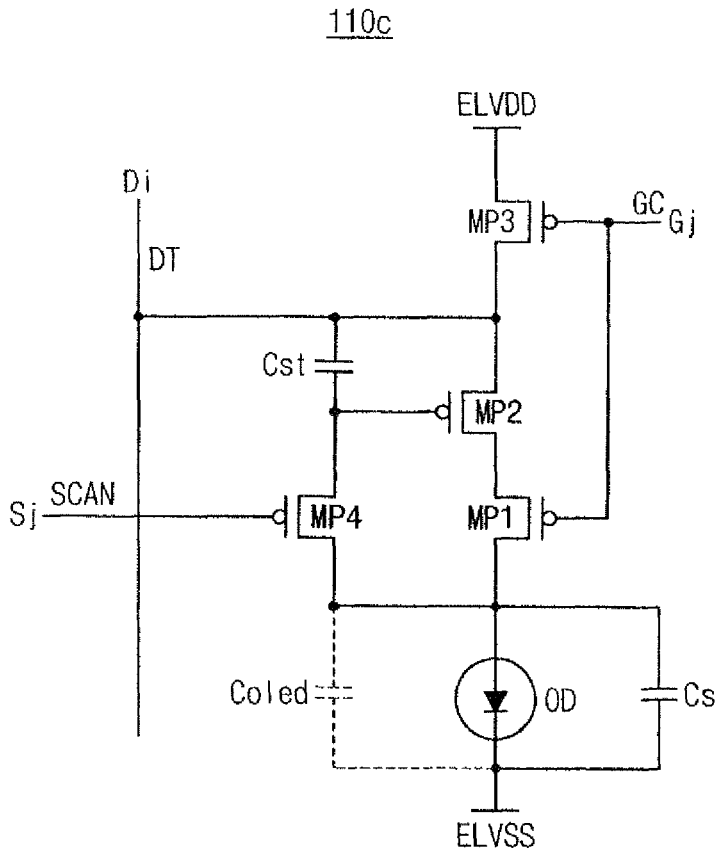
FIG. 5 is circuit diagram illustrating a second modification of the pixel circuit of FIG. 2.

FIG. 5 is a circuit diagram illustrating a second modification of the pixel circuit of FIG. 2 included in an organic light emitting display (OLED) device of FIG. 1.

A pixel circuit 110 in the organic light emitting display (OLED) device 10 of FIG. 1 may have the structure of a pixel circuit 110*c* illustrated in FIG. 5. In FIG. 5, the pixel circuit 110*c* is assumed to be placed at (j)th row and (i)th column.

Referring to FIG. 5, the pixel circuit 110*c* includes organic light emitting diode OD, PMOS transistor MP1, PMOS transistor MP2, PMOS transistor MP3, PMOS transistor MP4, storage capacitor Cst, and an auxiliary capacitor Cs.

Comparing pixel circuit 110*c* of FIG. 5 with pixel circuit 110*a* of FIG. 2, pixel circuit 110*c* of FIG. 5 may be equal to pixel circuit 110*a* of FIG. 2 except that the auxiliary capacitor Cs is included in pixel circuit 110*c* of FIG. 5. Therefore, only auxiliary capacitor Cs will be described because the structure and the operation of pixel circuit 110*a* of FIG. 2 were described referring to FIG. 1, FIG. 2, and FIG. 3.

The auxiliary capacitor Cs includes a first electrode coupled to the anode electrode of organic light emitting diode OD, and a second electrode coupled to the cathode electrode of organic light emitting diode OD. As illustrated in FIG. 5, the capacitance of parasitic capacitor Coled that internally exists in the organic light emitting diode OD may increase by adding the auxiliary capacitor Cs between both electrodes of organic light emitting diode OD.

As shown in Equation 2, when the capacitance of parasitic capacitor Coled that internally exists in organic light emitting diode OD increases, the luminance based on the same data signal increases because the current Ioled that flows through organic light emitting diode OD is expressed as $b/2*((Vdata-Vsus)*(Coled/(Coled+Cst)))^2$.

Therefore, an image having higher luminance may be displayed when the auxiliary capacitor Cs increases the capacitance of the parasitic capacitor Coled that internally exists in the organic light emitting diode OD.

Figure 6:
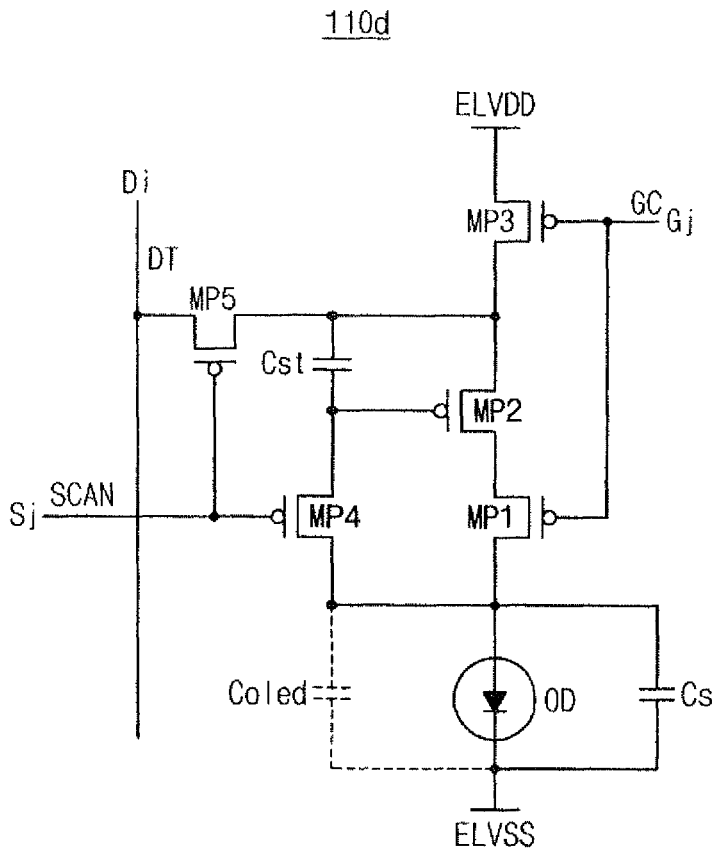
FIG. 6 is circuit diagram illustrating a third modification of the pixel circuit of FIG. 2.

FIG. 6 is a circuit diagram illustrating a third modification of the pixel circuit of FIG. 2 included in an organic light emitting display (OLED) device of FIG. 1.

A pixel circuit 110 in the organic light emitting display (OLED) device 10 of FIG. 1 may have the structure of a pixel circuit 110*d* illustrated in FIG. 6. In FIG. 6, the pixel circuit 100*d* is assumed to be placed at (j)th row and (i)th column.

Referring to FIG. 6, the pixel circuit 110*d* includes organic light emitting diode OD, PMOS transistor MP1, PMOS transistor MP2, PMOS transistor MP3, PMOS transistor MP4, storage capacitor Cst, the PMOS transistor MP5 of FIG. 4, and the auxiliary capacitor Cs of FIG. 5.

Comparing the pixel circuit 110*d* of FIG. 6 with the pixel circuit 110*a* of FIG. 2, is the pixel circuit 110*d* of FIG. 6 may be equal to the pixel circuit 110*a* of FIG. 2 except that the PMOS transistor MP5 and auxiliary capacitor Cs are included. Detailed descriptions about the pixel circuit 110*d* of FIG. 6 will be omitted because the structure and the operation of the pixel circuit 110*a* of FIG. 2 were described referring to FIG. 1, FIG. 2, and FIG. 3, PMOS transistor MP5 was described referring to FIG. 4, and auxiliary capacitor Cs was described referring to FIG. 5.

Figure 7:
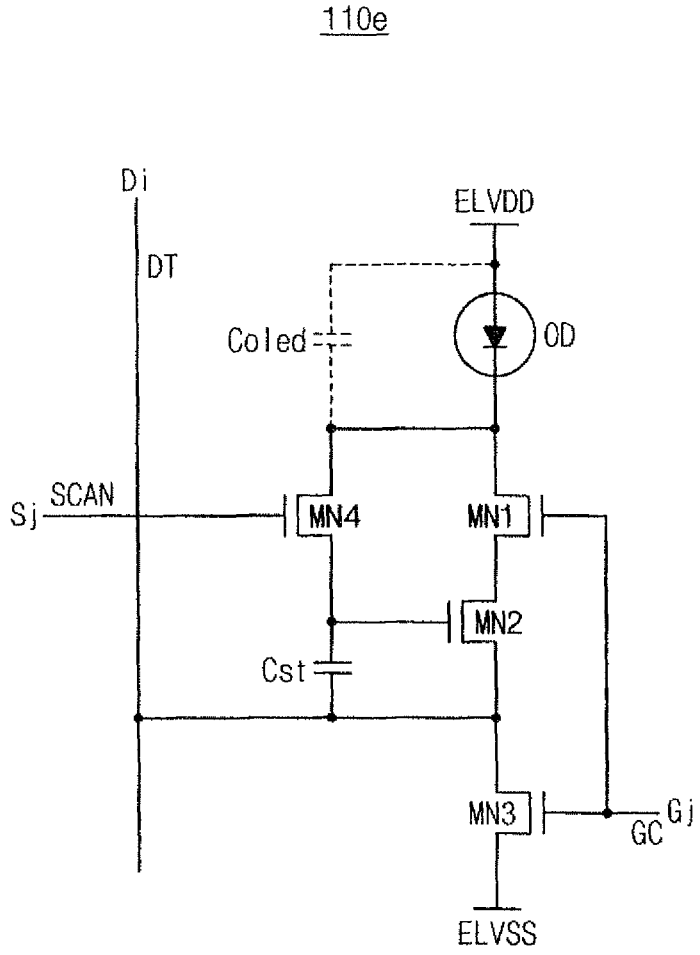
FIG. 7 is a circuit diagram illustrating still a second example of a pixel circuit included in an organic light emitting display (OLED) device of FIG. 1.

FIG. 7 is a circuit diagram illustrating still another example of a pixel circuit included in an organic light emitting display (OLED) device of FIG. 1.

A pixel circuit 110 in the organic light emitting display (OLED) device of FIG. 1 may have the structure of a pixel circuit 110*e* illustrated in FIG. 7.

As illustrated in FIG. 7, the pixel circuit 110*e* may be implemented by n-channel metal oxide semiconductor (NMOS) transistors. In FIG. 7, pixel circuit 110*e* is assumed to be placed at (j)th row and (i)th column (here, i and j denotes positive integers).

The pixel circuit 110*e* receives a scan signal SCAN through a scan-line Sj from scan driver 200 of FIG. 1. The pixel circuit 110*e* receives a gate control signal GC through a gate control-line Gj from gate driver 300 of FIG. 1. The pixel circuit 110*e* receives a data signal DT through a data-line Di from data driver 400 of FIG. 1. In addition, the pixel circuit 110*e* is supplied with a power source voltage ELVDD and a power source voltage ELVSS from voltage generation unit 500 of FIG. 1.

Referring to FIG. 7, pixel circuit 110*e* includes organic light emitting diode OD, an NMOS transistor MN1, an NMOS transistor MN2, an NMOS transistor MN3, an NMOS transistor MN4, and storage capacitor Cst.

The organic light emitting diode OD includes an anode electrode coupled to power source voltage ELVDD and a cathode electrode coupled to the second electrode of NMOS transistor MN1.

NMOS transistor MN1 includes a first electrode coupled to a second electrode of NMOS transistor MN2, a second electrode coupled to a cathode electrode of organic light is emitting diode OD, and a gate electrode coupled to a gate control-line Gj.

NMOS transistor MN2 includes a first electrode coupled to a second electrode of NMOS transistor MN3, the second electrode coupled to the first electrode of NMOS transistor MN1, and a gate electrode coupled, in common, to a first electrode of NMOS transistor MN4 and a second electrode of storage capacitor Cst. NMOS transistor MN2 operates as a driving transistor. The first electrode of NMOS transistor MN2 may be a source electrode, and the second electrode of NMOS transistor MN2 may be a drain electrode.

NMOS transistor MN3 includes a first electrode coupled to power source voltage ELVSS, the second electrode coupled, in common, to the first electrode of NMOS transistor MN2 and a first electrode of storage capacitor Cst, and a gate electrode coupled to a gate control-line Gj.

NMOS transistor MN4 includes a first electrode coupled, in common, to the gate electrode of NMOS transistor MN2 and a second electrode of storage capacitor Cst, a second electrode coupled, in common, to the second electrode of NMOS transistor MN1 and the cathode electrode of organic light emitting diode OD, and a gate electrode coupled to a scan-line Sj.

Storage capacitor Cst includes the first electrode coupled, in common, to the first electrode of NMOS transistor MN2 and a data-line Di, and the second electrode coupled, in common, to the gate electrode of NMOS transistor MN2 and the first electrode of NMOS transistor MN4.

In addition, the organic light emitting diode OD internally includes a parasitic capacitor Coled that is generated by the anode electrode and the cathode electrode of the organic light emitting diode OD. The parasitic capacitor Coled that internally exists in the organic light emitting diode OD is indicated by a dotted line between the anode electrode and the cathode electrode of the organic light emitting diode OD in FIG. 7.

As described below, pixel circuit 110*e* according to example embodiments uses a is coupling effect between storage capacitor Cst and parasitic capacitor Coled that internally exists in organic light emitting diode OD when a data signal DT provided through data-line Di is stored in storage capacitor Cst.

Figure 8:
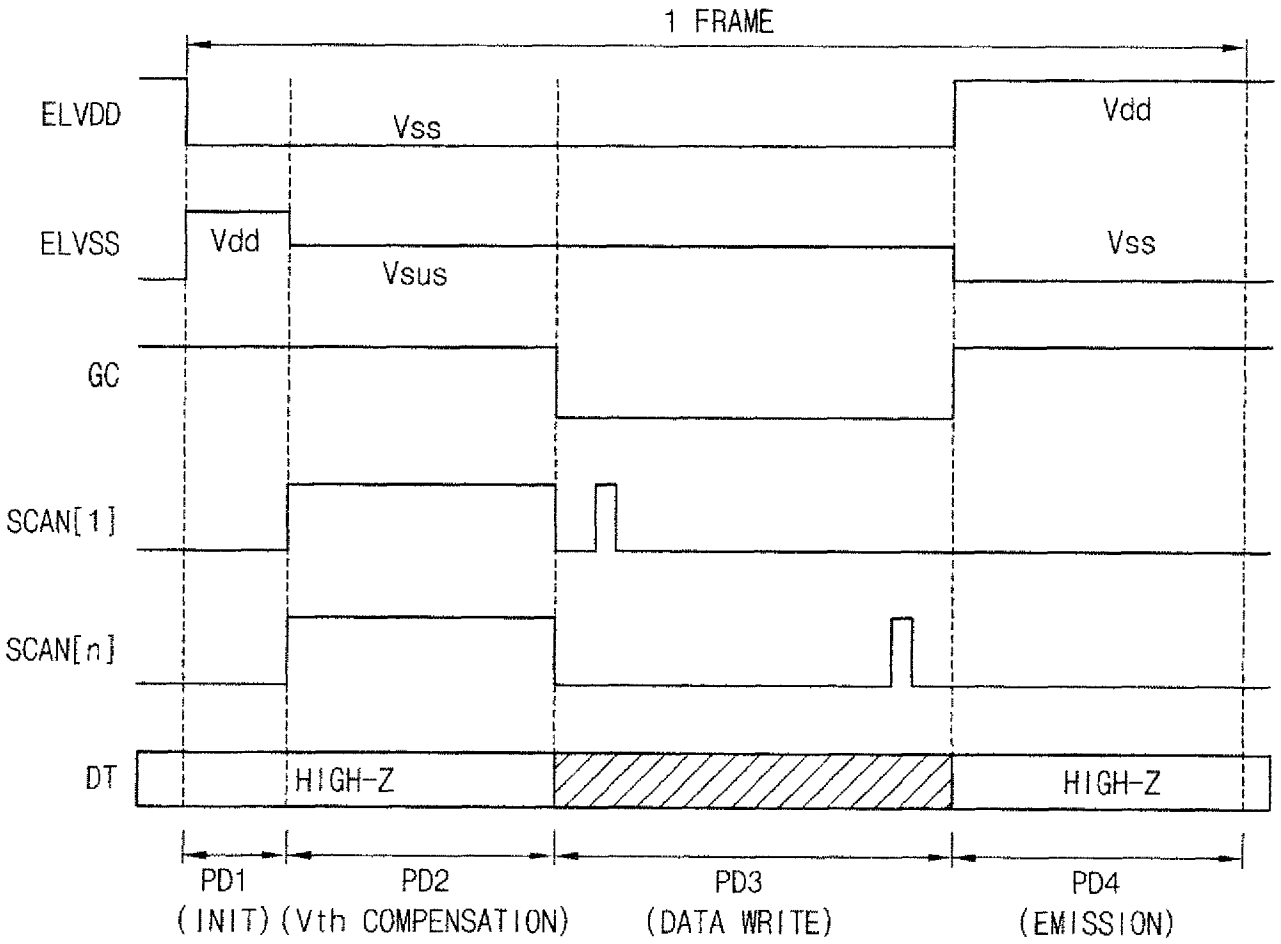
FIG. 8 is a timing diagram illustrating an operation of an organic light emitting display (OLED) device of FIG. 1.

FIG. 8 is a timing diagram illustrating an operation of an organic light emitting display (OLED) device of FIG. 1.

A pixel unit 100 in the organic light emitting display (OLED) device 10 of FIG. 1 may include the pixel circuit 110*e* of FIG. 7.

In FIG. 8, ELVDD represents a first power source voltage that is provided from voltage generation unit 500 to the pixel circuit 110*e*, and ELVSS represents a second power source voltage that is provided from voltage generation unit 500 to pixel circuit 110*e*. In addition, GC represents a gate control signal GC that is provided from gate driver 300 to pixel circuit 110*e*, and DT represents a data signal DT that is provided from data driver 400 to pixel circuit 110*e*. SCAN represents a scan signal SCAN that is provided from scan driver 200 to pixel circuit 110*e* that is coupled to a first scan-line S1. Thus, SCAN represents a scan signal SCAN that is provided from scan driver 200 to pixel circuit 110*e* that is coupled to the (n)th scan-line Sn.

Referring to FIG. 8, one frame period is divided into an initialization period PD1, a threshold voltage compensation period PD2, a data writing period PD3, and an emission period PD4.

As illustrated in FIG. 8, the gate control signal GC, the first power source voltage ELVDD, and the second power source voltage ELVSS may be commonly applied to all pixel circuits 110*e* that are included in pixel unit 100 during the initialization period PD1, the threshold voltage compensation period PD2, the data writing period PD3, and the emission period PD4. In addition, the scan signal SCAN may be commonly applied to all pixel circuits 110*e* that are included in pixel unit 100 during the initialization period PD1, the threshold voltage compensation period PD2, and the emission period PD4. However, the scan signal SCAN may be sequentially applied to each of the pixel circuits 110*e* that is is coupled to each of the scan-lines S1 through Sn during the data writing period PD3. Therefore, the data writing period PD3 may be sequentially performed for the pixel circuits 110*e* that are coupled to the scan-lines S1 through Sn. However, the initialization period PD1, the threshold voltage compensation period PD2, and the emission period PD4 may be simultaneously performed for the pixel circuits 110*e* that are coupled to the scan-lines S1 through Sn.

During the initialization period PD1, a voltage of the cathode electrode of organic light emitting diode OD that is included in each of the pixel circuits 110*e* is initialized. During the threshold voltage compensation period PD2, a threshold voltage of NMOS transistor MN2 is stored between both electrodes of storage capacitor Cst. That is, NMOS transistor MN2 may operate as a driving transistor in each of the pixel circuits 110*e*. During the data writing period PD3, the data signal DT is sequentially stored in storage capacitor Cst of each of the pixel circuits 110*e*. During the emission period PD4, light emitting is simultaneously performed in all pixel circuits 110*e* that are included in pixel unit 100. Therefore, the organic light emitting display (OLED) device 10 may be not driven by a progressive emission technique but a simultaneous emission with active voltage (SEAV) control technique.

Hereinafter, referring to FIG. 1, FIG. 7, and FIG. 8, operations of the organic light emitting display (OLED) device 10 will be described in detail.

During the initialization period PD1, voltage generation unit 500 may set the first power source voltage ELVDD as a first voltage Vss, and may provide the first voltage Vss to pixel circuit 110*e*. In addition, voltage generation unit 500 may set the second power source voltage ELVSS as a third voltage Vdd, and may provide the third voltage Vdd to pixel circuit 110*e*. The first voltage Vss may be lower than the third voltage Vdd. For instance, the first voltage Vss may be about 0V, and the third voltage Vdd may be about 12V. The gate driver 300 may provide the gate control signal GC having a logic high level to pixel circuit 110*e* through a gate control-line Gj. The scan driver 200 may provide the scan signal SCAN is having a logic low level to pixel circuit 110*e* through a scan-line Sj. The data driver 400 may provide the data signal DT that is in a high impedance (i.e., HIGH-Z) state to the data-line Di.

Therefore, during the initialization period PD1, NMOS transistor MN1 and NMOS transistor MN3 turn-on as the gate signal GC having a logic high level is applied to the gate electrode of NMOS transistor MN1 and the gate electrode of NMOS transistor MN3. In addition, PMOS transistor MP4 turns-off as the scan signal SCAN having a logic low level is applied to the gate electrode of NMOS transistor MN4. Further, NMOS transistor MN2 turns-on as the second power source voltage ELVSS is applied as the third voltage Vdd having a logic high level, and the gate electrode of NMOS transistor MN2 also has a voltage having a logic high level through storage capacitor Cst.

Namely, as NMOS transistor MN1 and NMOS transistor MN3 turn-on, and a current channel is formed between the first electrode and the second electrode of NMOS transistor MN2. Thus, the cathode electrode of organic light emitting diode OD is initialized to have the second power source voltage ELVSS (i.e., the third voltage Vdd).

Then, during the threshold voltage compensation period PD2, the first power source voltage ELVDD may be set as a first voltage Vss, and may be provided to pixel circuit 110*e* by voltage generation unit 500. In addition, the second power source voltage ELVSS may be set as a second voltage Vsus, and may be provided to pixel circuit 110*e* by voltage generation unit 500. Here, the second voltage Vsus is higher than the first voltage Vss, and is lower than the third voltage Vdd. For instance, the second voltage Vsus may be about 5V. The gate driver 300 may provide the gate control signal GC having a logic high level to pixel circuit 110*e* through a gate control-line Gj. The scan driver 200 may provide the scan signal SCAN having a high level to pixel circuit 110*e* through a scan-line Sj. The data driver 400 may provide the data signal DT that is in a high impedance (i.e., HIGH-Z) state to the data-line Di.

Thus, during the threshold voltage compensation period PD2, NMOS transistor is MN1 and NMOS transistor MN3 are maintained in a turn-on state because the gate signal GC having a logic high level is applied to the gate electrode of NMOS transistor MN1 and the gate electrode of NMOS transistor MN3. NMOS transistor MN2 is also maintained in a turn-on state. Meanwhile, NMOS transistor MN4 turns-on as the scan signal SCAN having a logic high level is applied to the gate electrode of NMOS transistor MN4. Thus, the second electrode of storage capacitor Cst and the gate electrode of NMOS transistor MN2 are electrically coupled to the cathode electrode of organic light emitting diode OD.

Therefore, a current flows from the cathode electrode of organic light emitting diode OD to the second power source voltage ELVSS until the threshold voltage of NMOS transistor MN2 is stored between both electrodes of storage capacitor Cst as a current channel is generated between the second power source voltage ELVSS and the cathode electrode of organic light emitting diode OD. As a result, the threshold voltage of NMOS transistor MN2 is stored between both electrodes of storage capacitor Cst, and a voltage of the cathode electrode of organic light emitting diode OD equals a voltage corresponding to the second voltage Vss plus the threshold voltage of NMOS transistor MN2.

Then, during the data writing period PD3, the first power source voltage ELVDD may be set as the first voltage Vss, and may be provided to pixel circuit 110*e* by voltage generation unit 500. The second power source voltage ELVSS may be set as the second voltage Vsus, and may be provided to pixel circuit 110*e* by voltage generation unit 500. Gate driver 300 may provide the gate control signal GC having a logic low level to pixel circuit 110*e* through the gate control-line Gj. Scan driver 200 may sequentially provide the scan signal SCAN having a logic high level to the scan-lines S1 through Sn. In detail, scan driver 200 may provide the scan signal SCAN having a high low level during the scan period in the data writing period PD3, and may provide the scan signal SCAN having a low level during the rest periods except the scan period in the data writing period PD3. The scan period may be sequentially set for the scan-lines S1 though Sn. Data driver 400 may provide the data signal DT corresponding to an image data that is displayed in pixel circuit 110*e* to the is data-line Di.

Therefore, during the data writing period PD3, NMOS transistor MN1 and NMOS transistor MN3 turn-off because the gate signal GC having a logic low level is applied to the gate electrode of NMOS transistor MN1 and the gate electrode of NMOS transistor MN3. NMOS transistor MN4 turns-on as the scan signal SCAN having a logic high level is applied to the gate electrode of NMOS transistor MN4 through the scan-line Sj during the scan period. The data signal DT provided through a data-line Di is applied to the first electrode of storage capacitor Cst.

Namely, during the data writing period PD3, the current that flows into the cathode electrode of organic light emitting diode OD through NMOS transistor MN2 is blocked because NMOS transistor MN1 and NMOS transistor MN3 turn-off. In addition, during the threshold voltage compensation period PD2, the threshold voltage of NMOS transistor MN2 is stored in both electrodes of storage capacitor Cst, and a voltage corresponding to the second voltage Vsus plus the threshold voltage of NMOS transistor MN2 is stored in the cathode electrode of the organic light emitting diode OD. Thus, as the data signal DT is applied to the first electrode of storage capacitor Cst during the scan period, a coupling effect between storage capacitor Cst and parasitic capacitor Coled that is placed in the organic light emitting diode OD is caused, and a voltage corresponding to a component, the component being proportional to the data signal DT, plus the threshold voltage of NMOS transistor MN2 is stored between both electrodes of storage capacitor Cst.

In detail, during the data writing period PD3, the voltage stored between both electrodes of storage capacitor Cst is expressed as Equation 3:

$$Vst=(Vsus-V\text{data})*(Coled/(Coled+Cst))+Vth \qquad \text{Equation 3}$$

(Here, Vst denotes a voltage stored between both electrodes of storage capacitor Cst, Vdata denotes a voltage of the data signal DT, and Vth denotes the threshold voltage of NMOS transistor MN2).

Then, during the emission period PD4, voltage generation unit 500 may set the first power source voltage ELVDD as the third voltage Vdd, and may provide the third voltage Vdd to pixel circuit 110*e*. In addition, voltage generation unit 500 may set the second power source voltage ELVSS as the first voltage Vss, and may provide the first voltage Vss to pixel circuit 110*e*. Gate driver 300 may provide the gate control signal GC having a logic high level to pixel circuit 110*e* through the gate control-line Gj. Scan driver 200 may provide the scan signal SCAN having a low level to pixel circuit 110*e* through the scan-line Sj. Data driver 400 may provide the data signal that is in a high impedance (i.e., HIGH-Z) state to a data-line Di.

Namely, during the emission period PD4, NMOS transistor MN1 and NMOS transistor MN3 turn-on as the gate signal GC having a logic high level is applied to the gate electrode of NMOS transistor MN1 and the gate electrode of NMOS transistor MN3. In addition, NMOS transistor MN4 turns-off as the scan signal SCAN having a logic low level is applied to the gate electrode of NMOS transistor MN4.

As illustrated in FIG. 7, during the emission period PD4, a current (i.e., the current corresponds to the voltage stored in storage capacitor Cst minus the threshold voltage of NMOS transistor MN2) flows in NMOS transistor MN2 as storage capacitor Cst is coupled between the gate electrode and the source electrode of NMOS transistor MN2.

As described above, the voltage stored between both electrodes of storage capacitor Cst during the data writing period PD3 is shown in Equation 3. Thus, the current that flows from organic light emitting diode OD through NMOS transistor MN2 during the emission period PD4 is expressed as Equation 4:

$$\begin{aligned} Ioled &= b/2*(Vgs - Vth)^2 \\ &= b/2*(Vst - Vth)^2 \\ &= b/2*((Vsus - Vdata)*(Coled/(Coled + Cst)))^2 \end{aligned} \quad \text{Equation 4}$$

(Here, Ioled denotes a current that flows through organic light emitting diode OD, b denotes a constant value, and Vgs denotes a voltage between the gate and the source of NMOS transistor MN2).

That is, the current Ioled that flows through organic light emitting diode OD is irrelevant to the threshold voltage of NMOS transistor MN2 that operates as the driving transistor, and is determined only by the data signal DT.

Therefore, pixel circuit 110*e* according to example embodiments may be irrelevant to the threshold voltage of NMOS transistor MN2 that operates as the driving transistor, and may emit light having a luminance determined only by the data signal DT. In addition, the organic light emitting diode display device 10 having pixel circuit 110*e* may compensate the deviation of the threshold voltage of each driving transistor, and may provide a uniform image.

Conventionally, in order to compensate the deviation of the threshold voltage of each driving transistor, a compensation circuit having a plurality of transistors and capacitors was used for each pixel circuit. Therefore, when the compensation circuit is added to each pixel circuit, the aperture ratio decreases because transistors and capacitors included in each pixel circuit, and signal-lines for controlling the transistors are added. In addition, the probability of defects increases because components of the pixel circuit increase, and the structure of the pixel circuit is complicated. Further, it is difficult to implement a high-speed scan driving because a capacitive load that is coupled to a scan-line increases.

However, as described above, pixel circuit 110*e* according to example embodiments may be implemented using four transistors and one storage capacitor Cst, and may store the data signal DT based on a coupling effect between storage capacitor Cst and parasitic capacitor Coled of organic light emitting diode OD. Accordingly, the process yield ratio and the aperture ratio may be improved as each pixel circuit is implemented using a few transistors and capacitors, and the high-speed scan driving may be enabled because capacitive load that is coupled to a scan-line decreases.

Figure 9:
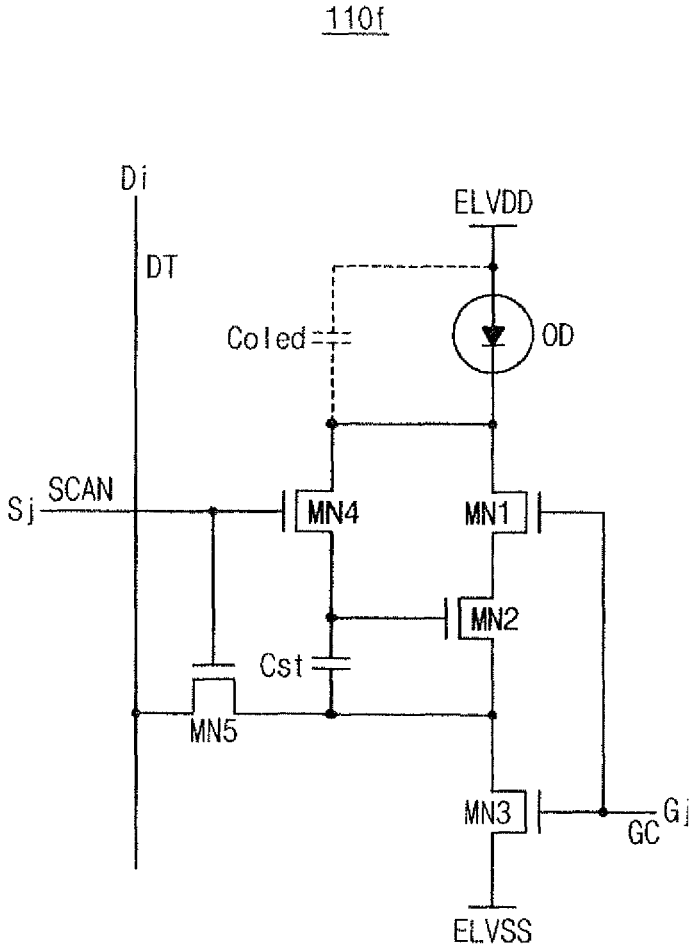
FIG. 9 is circuit diagram illustrating a first modification of the pixel circuit of FIG. 7.

FIG. 9 is a circuit diagram illustrating a first modification of the pixel circuit of is FIG. 7 included in an organic light emitting display (OLED) device of FIG. 1.

A pixel circuit 110 in the organic light emitting display (OLED) device 10 of FIG. 1 may have the structure of a pixel circuit 110*f* illustrated in FIG. 9. In FIG. 9, pixel circuit 110*f* is assumed to be placed at (j)th row and (i)th column.

Referring to FIG. 9, pixel circuit 110*f* includes organic light emitting diode OD, NMOS transistor MN1, NMOS transistor MN2, NMOS transistor MN3, NMOS transistor MN4, storage capacitor Cst and an NMOS transistor MN5.

Comparing the pixel circuit 110*f* of FIG. 9 with the pixel circuit 110*e* of FIG. 7, pixel circuit of 110*f* of FIG. 9 may be equal to pixel circuit 110*e* of FIG. 7 except that NMOS transistor MN5 is included in pixel circuit 110*f* of FIG. 9. Therefore, only NMOS transistor MN5 will be described because the structure and the operation of FIG. 7 were described referring to FIG. 1, FIG. 7, and FIG. 8.

NMOS transistor MN5 includes a first electrode coupled to a data-line Di, a second electrode coupled, in common to a first electrode of NMOS transistor MN2 and a first electrode of storage capacitor Cst, and a gate electrode coupled to a scan-line Sj. Therefore, the first electrode of NMOS transistor MN2 and the first electrode of storage capacitor Cst are not directly coupled to the data-line Di. That is, the first electrode of NMOS transistor MN2 and the first electrode of storage capacitor Cst are coupled to the data-line Di through NMOS transistor MN5.

The organic light emitting display (OLED) device 10 may equally operate as a timing diagram shown in FIG. 8 even if pixel unit 100 in the organic light emitting display (OLED) device 10 of FIG. 1 includes pixel circuit 110*f* of FIG. 9.

As described above, scan driver 200 may provide a scan signal SCAN having a logic high level only during a scan period in the data writing periods PD3, and may provide a scan signal SCAN having a logic low level during the rest periods except the scan period in the data writing period PD3.

Namely, a data signal DT provided through the data-line Di is applied to the first is electrode of storage capacitor Cst as NMOS transistor MN5 turns-on only during the scan period in the data writing period PD3. However, a data-line Di is electrically blocked from the first electrode of storage capacitor Cst as NMOS transistor MN5 turns-off during the rest periods except the scan period in the data writing period PD3.

Therefore, while the data signal DT is written in pixel circuits 110*f* coupled to other scan-lines, the first electrode of storage capacitor Cst and the data-line Di may be electrically blocked by NMOS transistor MN5. Thus, NMOS transistor MN5 may prevent the voltage that is stored between both electrodes of storage capacitor Cst from being changed by the data signal DT that is written in other scan-lines.

Figure 10:
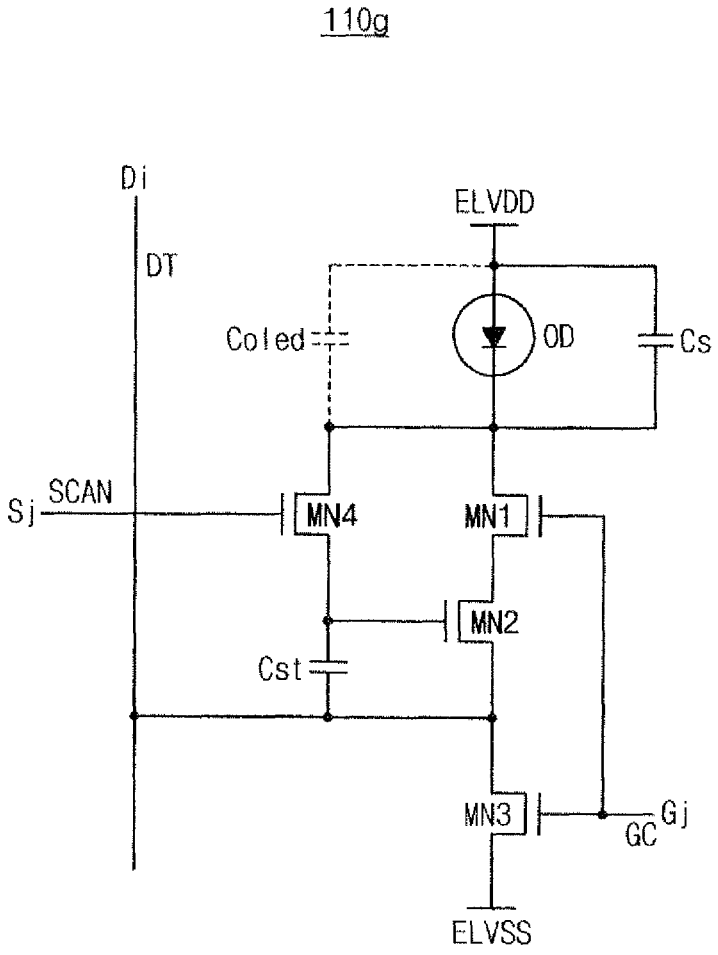
FIG. 10 is circuit diagram illustrating a second modification of the pixel circuit is of FIG. 7.

FIG. 10 is a circuit diagram illustrating a second modification of the pixel circuit of FIG. 7 included in an organic light emitting display (OLED) device of FIG. 1.

A pixel circuit 110 in the organic light emitting display (OLED) device 10 of FIG. 1 may have the structure of a pixel circuit 110*g* illustrated in FIG. 10. In FIG. 10, the pixel circuit 100B is assumed to be placed at (j)th row and (i)th column.

Referring to FIG. 10, pixel circuit 110*g* includes organic light emitting diode OD, NMOS transistor MN1, NMOS transistor MN2, NMOS transistor MN3, NMOS transistor MN4, storage capacitor Cst and an auxiliary capacitor Cs.

Comparing pixel circuit 110*g* of FIG. 10 with pixel circuit 110*e* of FIG. 7, pixel circuit 110*g* of FIG. 10 may be equal to pixel circuit 110*e* of FIG. 7 except that auxiliary capacitor Cs is included in pixel circuit 110*g* of FIG. 10. Therefore, only auxiliary capacitor Cs will be described because the structure and the operation of the pixel circuit 100*e* of FIG. 7 were described referring to FIG. 1, FIG. 7, and FIG. 8.

The auxiliary capacitor Cs includes a first electrode coupled to an anode electrode of organic light emitting diode OD, and a second electrode coupled to a cathode electrode of organic light emitting diode OD. As illustrated in FIG. 10, the capacitance of parasitic capacitor Coled that internally exists in the organic light emitting diode OD may increase by adding auxiliary capacitor Cs between both electrodes of organic light emitting diode OD.

As shown in Equation 4, when the capacitance of parasitic capacitor Coled that internally exists in organic light emitting diode OD increases, the luminance based on the same data signals increases because the current Ioled that flows through organic light emitting diode OD is expressed as $b/2*((Vsus-Vdata)*(Coled/(Coled+Cst)))^2$.

Therefore, an image having higher luminance may be displayed when auxiliary capacitor Cs increases the capacitance of parasitic capacitor Coled that internally exists in organic light emitting diode OD.

Figure 11:
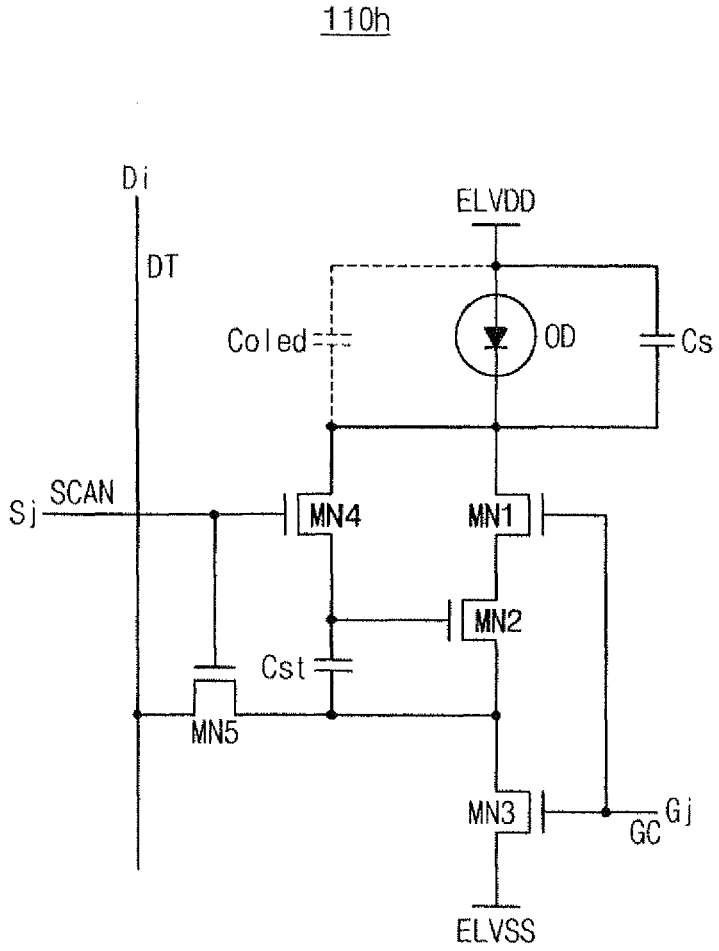
FIG. 11 is circuit diagram illustrating a third modification of the pixel circuit of FIG. 7.

FIG. 11 is a circuit diagram illustrating a third modification of the pixel circuit of FIG. 7 included in an organic light emitting display (OLED) device of FIG. 1.

A pixel circuit 110 in the organic light emitting display (OLED) device 10 of FIG. 1 may have the structure of a pixel circuit 110*h* illustrated in FIG. 11. In FIG. 11, the pixel circuit 100*h* is assumed to be placed at (j)th row and (i)th column.

Referring to FIG. 11, pixel circuit 110*h* includes organic light emitting diode OD, NMOS transistor MN1, NMOS transistor MN2, NMOS transistor MN3, NMOS transistor MN4, NMOS transistor MN5, storage capacitor Cst, and auxiliary capacitor Cs.

Comparing pixel circuit 110*h* of FIG. 11 with pixel circuit 110*e* of FIG. 7, pixel circuit 110*h* of FIG. 11 may be equal to pixel circuit 110*e* of FIG. 7 except that NMOS transistor MN5 and auxiliary capacitor Cs are included in pixel circuit 110*h* of FIG. 11. Detailed descriptions about pixel circuit 110*h* of FIG. 11 will be omitted because the structure and the operation of the pixel circuit 110*e* of FIG. 7 were described referring to FIG. 1, FIG. 7, and FIG. 8, and NMOS transistor MN5 was described referring to FIG. 9, and auxiliary capacitor Cs was described referring to FIG. 10.

Figure 12:
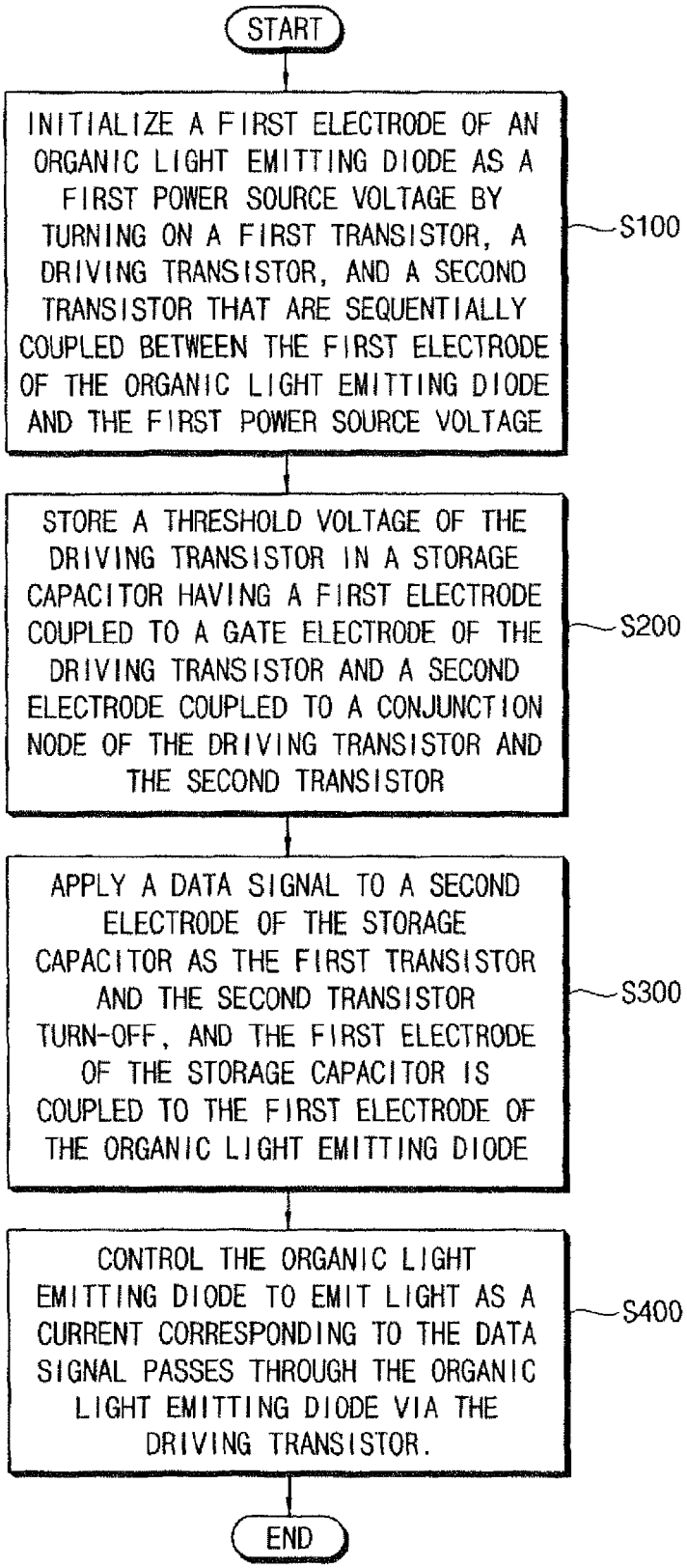
FIG. 12 is a flow chart illustrating a method of driving a pixel circuit according to example embodiments.

FIG. 12 is a flow chart illustrating a method of driving a pixel circuit according to example embodiments.

Referring to FIG. 12, a first electrode of an organic lighting emitting diode is initialized as a first power source voltage by turning on a first transistor, a driving transistor, and a second transistor (i.e., the first transistor, the driving transistor, and the second is transistor are sequentially coupled between the first electrode of the organic light emitting diode and the first power source voltage) (Step S100).

After the first electrode of the organic lighting emitting diode is initialized as the first power source voltage, a threshold voltage of the driving transistor is stored in a storage capacitor having a first electrode coupled to a gate electrode of the driving transistor and a second electrode coupled to a conjunction node of the driving transistor and the second transistor (Step S200). At this time, the threshold voltage of the driving transistor may be stored in the storage capacitor when the first transistor and the second transistor turn-on, and the first electrode of the storage capacitor is coupled to the first electrode of the organic light emitting diode.

After the threshold voltage of the driving transistor is stored in the storage capacitor, the first transistor and the second transistor turn-off, the first electrode of the storage capacitor is coupled to the first electrode of the organic light emitting diode, and a data signal is applied to the second electrode of the storage capacitor (Step S300). Since the first transistor and the second transistor turn-off, a current is input to the first electrode of the organic light emitting diode through the driving transistor, and a current output from the first electrode of the organic light emitting diode is blocked. Therefore, a voltage corresponding to a component, the component being proportional to the data signal, plus the threshold voltage of the driving transistor may be stored in the storage capacitor because a coupling effect between the storage capacitor and a parasitic capacitor that internally exists in the organic light emitting diode is caused.

Then, the organic light emitting diode emits light as a current corresponding to the data signal passes through the organic light emitting diode via the driving transistor (Step S400). In detail, the driving transistor allows a current, the current corresponding to a voltage that is generated by subtracting the threshold voltage of the driving transistor from the stored voltage in the storage capacitor, to pass through when the first transistor and the second transistor turn-on, and the first electrode of the storage capacitor is blocked from the is first electrode of the organic light emitting diode. As described above, the voltage corresponding to a component, the component being proportional to the data signal, plus the threshold voltage of the driving transistor is stored in the storage capacitor. Thus, a current, the current being irrelevant to the threshold voltage of the driving transistor and being determined only by the data signal, is applied by the driving transistor. Therefore, the organic light emitting diode may emit light having a luminance determined only by the data signal. That is, the luminance is irrelevant to the threshold voltage of the driving transistor.

In one example embodiment, the driving transistor, the first transistor, and the second transistor may be PMOS transistors.

In another example embodiment, the driving transistor, the first transistor, and the second transistor may be NMOS transistors.

The method of FIG. 12 may be performed based on any of the pixel circuits illustrated in FIG. 2, FIG. 4, FIG. 5, FIG. 6, FIG. 7, FIG. 9, FIG. 10, and FIG. 11 (i.e., pixel circuits 110*a*, 110*b*, 110*c*, 110*d*, 110*e*, 110*f*, 110*g*, and 110*h*). The structure and the operation of the pixel circuits illustrated in FIG. 2, FIG. 4, FIG. 5, FIG. 6, FIG. 7, FIG. 9, FIG. 10, and FIG. 11 were described above.

Figure 13:
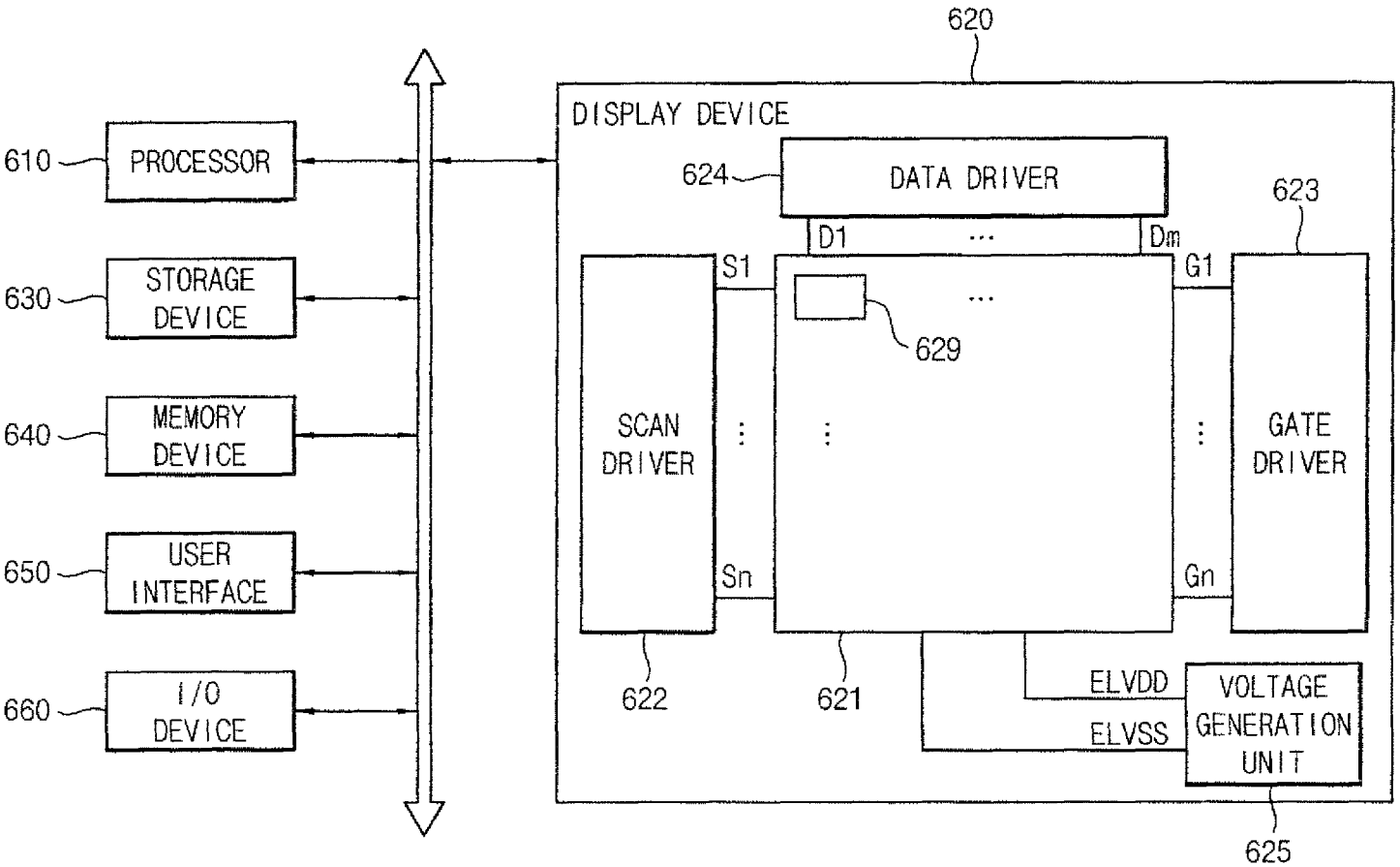
FIG. 13 is a block diagram illustrating a display system according to example embodiments.

FIG. 13 is a block diagram illustrating a display system according to example embodiments.

Referring to FIG. 13, the display system 600 includes a processor 610, an organic light emitting display device 620, and a storage device 630.

The storage device 630 stores image data. The storage device 630 may include a solid state drive (SDD), a hard disk drive (HDD), a CD-ROM, any kind of non-volatile memory device, etc.

The processor 610 reads the image data stored in the storage device 630, and provides image signals to the organic light emitting display device 620.

The organic light emitting display device 620 displays the image signals received from the processor 610. The organic light emitting display device 620 includes a pixel unit 621, a scan driver 622, a gate driver 623, a data driver 624, and a voltage generation unit 625.

The pixel unit 621 is coupled to the scan driver 622 through a plurality of scan-lines S1 through Sn. The pixel unit 621 is coupled to the gate driver 623 through a plurality of gate control-lines G1 through Gn. The pixel unit 621 is coupled to the data driver 624 through a plurality of data-lines D1 through Dm. In addition, the pixel unit 621 is supplied with a first power source voltage ELVDD and a second power source voltage ELVSS from the voltage generation unit 625.

The pixel unit 621 includes n×m pixel circuits 629 that are placed at crossing points of the scan-lines S1 through Sn, the gate control-lines G1 through Gn, and the data-lines D1 through Dm. Each of the pixel circuits 629 includes an organic light emitting diode.

The scan driver 622 provides scan signals to each of a plurality of pixel circuits 629 through a plurality of scan-lines S1 through Sn. The gate driver 623 provides gate control signals to each of a plurality of pixel circuits 629 through a plurality of gate control-lines G1 through Gn. The data driver 624 provides data signals to each of a plurality of pixel circuits 629 through a plurality of data-lines D1 through Dm.

The voltage generation unit 625 provides the first power source voltage ELVDD and the second power source voltage ELVSS to each of a plurality of pixel circuits 629.

The organic light emitting diode emits light having a luminance corresponding to the data signals as each of the pixel circuits 629 receives the scan signal, the gate control signal, the data signal, the first power source voltage ELVDD, and the second power source voltage ELVSS.

Each of the pixel circuits 629 may be implemented by any of the pixel circuits illustrated in FIG. 2, FIG. 4, FIG. 5, FIG. 6, FIG. 7, FIG. 9, FIG. 10, and FIG. 11 (i.e., pixel circuits 110*a*, 110*b*, 110*c*, 110*d*, 110*e*, 110*f*, 110*g*, and 110*h*). As the structure and the operation of the pixel circuits illustrated in FIG. 2, FIG. 4, FIG. 5, FIG. 6, FIG. 7, FIG. 9, FIG. 10, and FIG. 11 were described above, detailed descriptions of the pixel circuit 629 will is be omitted.

The processor 610 may perform various computing functions such as specific calculation or tasks. According to example embodiments, the processor 610 may be a microprocessor or a central processing unit (CPU). The processor 610 may be coupled to the display device 620 and the storage device 630 through an address bus, a control bus, and a data bus to perform communications. According to example embodiments, the processor 610 may be coupled to an extension bus such as a peripheral component interconnects (PCI) bus.

Meanwhile, the processor 610 may be a single-core processor or a multi-core processor. For instance, an ARM core processor may be implemented by the single-core processor when the ARM core processor operates using a system clock less than about 1 GHz. In addition, the ARM core processor may be implemented by the multi-core processor when the ARM core processor operates at high speed using a system clock more than about 1 GHz. Further, the ARM core processor may perform communications with peripheral devices based on an advanced extensible interface (AXI) bus.

The display system 600 may further include a memory device 640, a user interface 650, and an I/O device 660. In addition, the display system 600 may further include many ports capable of communicating with a video card, a sound card, a memory card, a USB device, other electric devices, etc.

The memory device 640 may store data that is necessary for operations of the display system 600. For instance, the memory device 640 may include a volatile memory device such as a dynamic random access memory (DRAM) device, a static random access memory (SRAM), etc, and a non-volatile memory device such as an erasable programmable read-only memory (EPROM) device, an electrically erasable programmable read-only memory (EEPROM) device, a flash memory device, etc.

The user interface 650 may include various means that is necessary for operations of the display system 600. The I/O device 660 may include input means such as a keyboard, a key pad, a mouse, etc, and output means such as a printer.

The display system 600 may be construed as an arbitrary electric device that includes a cellular phone, a smart phone, a personal digital assistant (PDA), a desktop computer, a television, a laptop computer, a personal media player (PMP), etc.

As described above, the present inventive concept is related to a pixel circuit capable of compensating a threshold voltage distribution of a transistor using a few transistors and capacitors. Therefore, the present inventive concept may be applied to an arbitrary display device the pixel circuit. Especially, the present inventive concept may be usefully utilized for an arbitrary display device to provide a uniform image, an improved process yield ratio, and an improved aperture ratio.

What is claimed is:

1. A pixel circuit having first and second power source voltages, the pixel circuit comprising:

an organic light emitting diode, a cathode electrode of the organic light emitting diode being coupled to the second power source voltage;

a first p-channel metal oxide semiconductor (PMOS) transistor having a first electrode, a second electrode coupled to an anode electrode of the organic light emitting diode, and a gate electrode coupled to a gate control-line;

a second PMOS transistor having a first electrode and having a second electrode coupled to the first electrode of the first PMOS transistor;

a third PMOS transistor having a first electrode coupled to the first power source voltage, a second electrode coupled to the first electrode of the second PMOS transistor, and a gate electrode coupled to the gate control-line;

a fourth PMOS transistor having a first electrode coupled to the gate electrode of the second PMOS transistor, a second electrode coupled to the anode electrode of the organic light emitting diode, and a gate electrode coupled to a scan-line; and a storage capacitor having a first electrode coupled, in common, to the first electrode of the second PMOS transistor and a data-line, and a second electrode coupled to the gate electrode of the second PMOS transistor, wherein during an initialization period, the first power source voltage is set as a first voltage lower than the second power source voltage, the gate electrode of the first PMOS transistor and the gate electrode of the third PMOS transistor receive a gate control signal having a logic low level through the gate control-line, and the gate electrode of the fourth PMOS transistor receives a scan signal having a logic high level through the scan-line.

2. The pixel circuit of claim 1, wherein the anode electrode of the organic light emitting diode is initialized as the first voltage as the first PMOS transistor, the second PMOS transistor, and the third PMOS transistor turn-on, and the fourth PMOS transistor turns-off during the initialization period.

3. The pixel circuit of claim 1, wherein during a threshold voltage compensation period, the first power source voltage is set as a second voltage lower than the second power source voltage, the gate electrode of the first PMOS transistor and the gate electrode of the third PMOS transistor receive a gate control signal having a logic low level through the gate control-line, and the gate electrode of the fourth PMOS transistor receives a scan signal having a logic low level through the scan-line.

4. The pixel circuit of claim 3, wherein a threshold voltage of the second PMOS transistor is stored in the storage capacitor, and the anode electrode of the organic light emitting diode is set as a voltage corresponding to the second voltage minus the threshold voltage of the second PMOS transistor as the first PMOS transistor, the second PMOS transistor, the third PMOS transistor, and the fourth PMOS transistor turn-on during the threshold voltage compensation period.

5. The pixel circuit of claim 1, wherein during a data writing period, the gate electrode of the first PMOS transistor and the gate electrode of the third PMOS transistor receive a gate control signal having a logic high level through the gate control-line, and the gate electrode of the fourth PMOS transistor receives a scan signal having a logic low level through the scan-line during a scan period of the data writing period and receives a scan signal having a logic high level during rest periods except the scan period of the data writing period.

6. The pixel circuit of claim 5, wherein the first PMOS transistor and the third PMOS transistor turn-off during the data writing period, the fourth PMOS transistor turns-on during the scan period, a data signal that is provided through the data-line is applied to the first electrode of the storage capacitor, and a voltage corresponding to a component, the component being proportional to the data signal, plus the threshold voltage of the second PMOS transistor is stored in the storage capacitor based on a coupling effect between the storage capacitor and a parasitic capacitor of the organic light emitting diode.

7. The pixel circuit of claim 1, wherein during an emission period, the first power source voltage is set as a third voltage higher than the second power source voltage, the gate electrode of the first PMOS transistor and the gate electrode of the third PMOS transistor receives a gate control signal having a logic low level through the gate control-line, and the gate electrode of the fourth PMOS transistor receives a scan signal having a logic high level through the scan-line.

8. The pixel circuit of claim 7, wherein a current corresponding to the data signal flows from the first power source voltage into the second power source voltage via the organic light emitting diode by the second PMOS transistor as the first PMOS transistor and the third PMOS transistor turn-on, and the fourth PMOS transistor turns-off during the emission period, the current being irrelevant to the threshold voltage of the second PMOS transistor.

9. The pixel circuit of claim 1, further comprising:

a fifth PMOS transistor having a first electrode coupled to the data-line, a second electrode coupled to the first electrode of the storage capacitor, and a gate electrode coupled to the scan-line, wherein the first electrode of the storage capacitor is coupled to the data-line through the fifth PMOS transistor.

10. A pixel circuit, having first and second power source voltages, the pixel circuit comprising:

an organic light emitting diode, a cathode electrode of the organic light emitting diode being coupled to the second power source voltage;

a first p-channel metal oxide semiconductor (PMOS) transistor having a first electrode, a second electrode coupled to an anode electrode of the organic light emitting diode, and a gate electrode coupled to a gate control-line;

a second PMOS transistor having a first electrode and having a second electrode coupled to the first electrode of the first PMOS transistor;

a third PMOS transistor having a first electrode coupled to the first power source voltage, a second electrode coupled to the first electrode of the second PMOS transistor, and a gate electrode coupled to the gate control-line;

a fourth PMOS transistor having a first electrode coupled to the gate electrode of the second PMOS transistor, a second electrode coupled to the anode electrode of the organic light emitting diode, and a gate electrode coupled to a scan-line;

a storage capacitor having a first electrode coupled, in common, to the first electrode of the second PMOS transistor and a data-line, and a second electrode coupled to the gate electrode of the second PMOS transistor; and an auxiliary capacitor having a first electrode coupled to the anode electrode of the organic light emitting diode and a second electrode coupled to the cathode electrode of the organic light emitting diode.

11. An organic light emitting display device comprising:

a pixel unit having a plurality of pixel circuits that are placed at crossing points of a plurality of scan-lines, a plurality of gate control-lines, and a plurality of data-lines;

a scan driver configured to provide a scan signal to the scan-lines;

a gate driver configured to provide a gate control signal to the gate control-lines;

a data driver configured to provide a data signal to the data control-lines; and a voltage generation unit configured to provide a first power source voltage and a second power source voltage to the pixel unit, wherein each of the pixel circuits includes:

an organic light emitting diode, a cathode electrode of the organic light emitting diode being coupled to the second power source voltage;

a first PMOS transistor having a first electrode, a second electrode coupled to an anode electrode of the organic light emitting diode, and a gate electrode coupled to the gate control-line;

a second PMOS transistor having a first electrode and a second electrode coupled to the first electrode of the first PMOS transistor;

a third PMOS transistor having a first electrode coupled to the first power source voltage, a second electrode coupled to the first electrode of the second PMOS transistor, and a gate electrode coupled to the gate control-line;

a fourth PMOS transistor having a first electrode coupled to the gate electrode of the second PMOS transistor, a second electrode coupled to the anode electrode of the organic light emitting diode, and a gate electrode coupled to the scan-line; and a storage capacitor having a first electrode coupled, in common, to the first electrode of the second PMOS transistor and the data-line, and a second electrode coupled to the gate electrode of the second PMOS transistor, wherein the pixel unit writes image data in each of the pixel circuits during a data writing period of one frame period, and each of the pixel circuits simultaneously emits light during an emission period of one frame period by the pixel unit.

12. The organic light emitting display device of claim 11, wherein during the data writing period, the gate driver simultaneously applies the gate control signal having a logic high level to each of the gate control-lines, and the scan driver sequentially applies the scan signal having a logic low level to each of the scan-lines.

13. The organic light emitting display device of claim 12, wherein during the data writing period, the first PMOS transistor and the third PMOS transistor turn-off, and a voltage corresponding to a component, the component being proportional to data signal that is provided through the data driver, plus the threshold voltage of the second PMOS transistor is stored in the storage capacitor based on a coupling effect of the storage capacitor and a parasitic capacitor of the organic light emitting diode, the first PMOS transistor, the third PMOS transistor, the storage capacitor, and the parasitic capacitor of the organic light emitting diode being included in each of the pixel circuits.

14. A method of driving a pixel circuit, the method comprising:

initializing a first electrode of an organic light emitting diode as a first power source voltage by turning on a first transistor, a driving transistor, and a second transistor that are sequentially coupled between the first electrode of the organic light emitting diode and the first power source voltage;

storing a threshold voltage of the driving transistor in a storage capacitor having a first electrode coupled to a gate electrode of the driving transistor, and a second electrode coupled to a conjunction node of the driving transistor and the second transistor;

applying a data signal to a second electrode of the storage capacitor as the first transistor and the second transistor turn-off, and the first electrode of the storage capacitor is coupled to the first electrode of the organic light emitting diode; and controlling the organic light emitting diode to emit light as a current corresponding to the data signal passes through the organic light emitting diode via the driving transistor.

15. The method of claim 14, wherein storing the threshold voltage of the driving transistor in the storage capacitor includes:

turning-on the first transistor and the second transistor; and coupling the first electrode of the storage capacitor to the first electrode of the organic light emitting diode.

16. The method of claim 14, wherein applying the data signal includes:

storing a voltage corresponding to a component, the component being proportional to the data signal, plus the threshold voltage of the driving transistor in the storage capacitor based on a coupling effect between the storage capacitor and a parasitic capacitor of the organic light emitting diode.

17. The method of claim 14, wherein controlling the organic light emitting diode to emit light includes:

turning-on the first transistor and the second transistor; and blocking the first electrode of the storage capacitor from the first electrode of the organic light emitting diode.

* * * * *